US010012922B2

(12) United States Patent
Yoshida et al.

(10) Patent No.: US 10,012,922 B2
(45) Date of Patent: Jul. 3, 2018

(54) TONER AND METHOD FOR PRODUCING TONER

(71) Applicant: CANON KABUSHIKI KAISHA, Tokyo (JP)

(72) Inventors: Yu Yoshida, Mishima (JP); Yuhei Terui, Numazu (JP); Haruko Kubo, Fukui (JP); Hitoshi Itabashi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/456,833

(22) Filed: Mar. 13, 2017

(65) Prior Publication Data

US 2017/0269494 A1 Sep. 21, 2017

(30) Foreign Application Priority Data

Mar. 18, 2016 (JP) ..... 2016-055236

(51) Int. Cl.

*G03G 9/09* (2006.01)
*G03G 9/087* (2006.01)
*G03G 9/08* (2006.01)
*G03G 9/097* (2006.01)

(52) U.S. Cl.

CPC ..... *G03G 9/0924* (2013.01); *G03G 9/0804* (2013.01); *G03G 9/0806* (2013.01); *G03G 9/0819* (2013.01); *G03G 9/08711* (2013.01); *G03G 9/08726* (2013.01); *G03G 9/08755* (2013.01); *G03G 9/092* (2013.01); *G03G 9/0918* (2013.01); *G03G 9/09733* (2013.01)

(58) Field of Classification Search

CPC .. G03G 9/0918; G03G 9/092; G03G 9/08726; G03G 9/08755; G03G 9/08711; G03G 9/0924; G03G 9/0804

See application file for complete search history.

(56) References Cited

U.S. PATENT DOCUMENTS 4,810,297 A * 3/1989 Takei ..... C09B 47/16 106/169.11
4,920,217 A * 4/1990 Lambie ..... C09B 47/16 540/135
5,279,654 A * 1/1994 Keirs ..... C09B 67/0035 106/31.67
5,494,770 A 2/1996 Baba et al.
5,573,880 A 11/1996 Mayama et al.
5,576,133 A 11/1996 Baba et al.
5,744,278 A 4/1998 Ayaki et al.
5,985,502 A 11/1999 Ayaki et al.
6,083,655 A 7/2000 Itabashi et al.
6,106,990 A 8/2000 Tazawa et al.
6,124,070 A 9/2000 Baba et al.
6,165,663 A 12/2000 Baba et al.
6,500,593 B2 12/2002 Abe et al.
6,566,028 B2 5/2003 Tazawa et al.
6,689,525 B2 2/2004 Itabashi
6,790,576 B2 9/2004 Fujimoto et al.
6,808,855 B2 10/2004 Ayaki et al.
7,323,282 B2 1/2008 Ohno et al.
8,053,156 B2 11/2011 Abe et al.
8,178,275 B2 5/2012 Tani et al.
8,383,312 B2 2/2013 Fujimoto et al.
8,440,382 B2 5/2013 Isono et al.
8,497,054 B2 7/2013 Sugiyama et al.
8,574,801 B2 11/2013 Itabashi et al.
8,609,312 B2 12/2013 Itabashi et al.
8,652,725 B2 2/2014 Watanabe et al.
8,652,737 B2 2/2014 Handa et al.
8,778,581 B2 7/2014 Nonaka et al.
8,828,633 B2 9/2014 Itabashi et al.
8,883,946 B2 11/2014 Yasumatsu et al.
8,916,319 B2 12/2014 Ikeda et al.
8,940,467 B2 1/2015 Hashimoto et al.
8,975,000 B2 3/2015 Tani et al.
9,029,056 B2 5/2015 Kenmoku et al.
9,079,989 B2 7/2015 Yasumatsu et al.
9,098,002 B2 8/2015 Kenmoku et al.
9,098,003 B2 8/2015 Masumoto et al.
9,158,216 B2 10/2015 Shimano et al.
9,229,345 B2 1/2016 Ikeda et al.
9,377,705 B2 6/2016 Shimano et al.
9,383,668 B2 7/2016 Noji et al.
9,575,424 B2 2/2017 Nakagawa et al.
9,599,919 B2 3/2017 Isono et al.
9,632,441 B2 4/2017 Abe et al.
2009/0123859 A1* 5/2009 Moribe ..... G03G 9/09708 430/108.1
2009/0293769 A1* 12/2009 Lee ..... C09B 67/0002 106/411
2012/0172562 A1* 7/2012 Kenmoku ..... C08F 12/24 526/287
2013/0065174 A1 3/2013 Itabashi et al.

(Continued)

FOREIGN PATENT DOCUMENTS

EP 0508704 A1 * 10/1992 ..... C09B 47/16
JP 63248864 A 10/1988

(Continued)

OTHER PUBLICATIONS

English language machine translation of JP 06-214426 (Aug. 1994).*

*Primary Examiner* — Christopher D Rodee
(74) *Attorney, Agent, or Firm* — Fitzpatrick Cella Harper and Scinto

(57) ABSTRACT

A toner comprising a toner particle containing a pigment, a resin A and a resin B, wherein the pigment is a pigment having a structure derived from a basic compound, the resin A has an acidic functional group, the resin B has an acid value of at least 2.0 mg KOH/g, the resin B has a glass transition temperature TgB of at least 50° C., and the hydrophobic parameter HPA of the resin A and the hydrophobic parameter of the resin B satisfy the following formulae:

$$HPA \geq 0.60$$

$$HPB \leq 0.70$$

$$HPA - HPB > 0.$$

17 Claims, No Drawings

(56) References Cited

U.S. PATENT DOCUMENTS

| | | | | |
|---|---|---|---|---|
| 2014/0072908 | A1* | 3/2014 | Masumoto | G03G 9/08791 430/108.2 |
| 2014/0080989 | A1* | 3/2014 | Yasumatsu | G03G 9/08704 526/292.9 |
| 2014/0087299 | A1* | 3/2014 | Kenmoku | G03G 9/0806 430/108.2 |
| 2015/0099220 | A1 | 4/2015 | Abe et al. | |
| 2015/0099222 | A1 | 4/2015 | Terui et al. | |
| 2015/0153669 | A1 | 6/2015 | Yoshida et al. | |
| 2015/0370189 | A1 | 12/2015 | Tanaka et al. | |
| 2016/0246192 | A1 | 8/2016 | Yoshida et al. | |
| 2016/0349646 | A1 | 12/2016 | Yoshida et al. | |
| 2017/0052465 | A1 | 2/2017 | Shimano et al. | |

FOREIGN PATENT DOCUMENTS

| | | | | |
|---|---|---|---|---|
| JP | S63-270060 | | | 11/1988 |
| JP | 06214426 | A | * | 8/1994 |
| JP | 2004-045654 | | | 2/2004 |
| JP | 2005-181835 | | | 7/2005 |
| JP | 2005215501 | A | | 8/2005 |
| JP | 2007131832 | A | | 5/2007 |
| JP | 4097312 | A | | 6/2008 |
| JP | 4361676 | A | | 11/2009 |
| JP | 4484171 | | | 6/2010 |
| JP | 2012-133192 | | | 7/2012 |
| JP | 2012-256044 | | | 12/2012 |
| JP | 2014222356 | A | | 11/2014 |
| JP | 2015-125406 | | | 7/2015 |
| JP | 2015148731 | A | | 8/2015 |

* cited by examiner

TONER AND METHOD FOR PRODUCING TONER

BACKGROUND OF THE INVENTION

Field of the Invention

The present invention relates to a toner for use in image-forming methods such as electrophotographic methods, electrostatic recording methods and toner jet methods, and to a method for producing toner.

Description of the Related Art

In recent years, printers and copiers are being subjected to demands for smaller size and longer operating lives. Now that they are being used in a variety of environments, moreover, they are also required to have improved storage stability under high-temperature conditions. An effective way to reduce the size of a device is to increase the tinting strength of a toner. Because an image can be formed with a small amount of toner by increasing the tinting strength, the toner container can be smaller. An effective means of increasing the tinting strength of a toner is to finely disperse the pigment. Pigments are being surface treated as a means of improving pigment dispersibility. Japanese Patent Application Publication No. 2012-133192 describes an example using a pigment that has been surface treated.

However, using only a surface-treated pigment such as that described in Japanese Patent Application Publication No. 2012-133192, adequate dispersibility may not be obtained, and tinting strength may not be obtained at a high level. Japanese Patent Application Publication No. 2005-181835 suggests the possibility that a higher level of tinting strength could be obtained by using a pigment dispersant that makes use of acid-base interactions.

Further, an effective means of achieving longer operating lives and heat-resistant storability is to improve the durability and heat-resistant storability of the toner. Japanese Patent Application Publication No. 2015-125406 describes an example using a polar resin with a high glass transition temperature, and research is being performed aimed at improving durability and heat-resistant storability.

SUMMARY OF THE INVENTION

When these techniques are combined, however, the polar resin may be adsorbed by acid-base or other interactions onto the surface-treated pigment, increasing the polarity of the pigment dispersion. This can cause the pigment to aggregate or reduce the dispersibility of the polar resin so that the various original properties are not obtained. It has therefore been difficult to achieve both high tinting strength and durability.

Even when a conventional pigment dispersant is used at the same time, moreover, it has sometimes been difficult to suppress interactions such as those discussed above.

The present invention provides a toner that solves these problems. That is, it is an object of the present invention to provide a toner having both high tinting strength and durability, together with a manufacturing method therefor.

The present invention is a toner comprising a toner particle containing:

a pigment having a structure derived from a basic compound;

a resin A having an acidic functional group; and a resin B having an acid value of at least 2.0 mg KOH/g, wherein the resin B has a glass transition temperature TgB of at least 50° C., and a hydrophobic parameter HPA of the resin A and a hydrophobic parameter HPB of the resin B satisfy the following formulae:

$$HPA \geq 0.60$$

$$HPB \leq 0.70$$

$$HPA - HPB > 0$$

in the formulae, HPA represents a volume fraction of heptane at a point of precipitation by the resin A as measured by the addition of heptane to a solution containing 0.01 mass parts of the resin A and 1.48 mass parts of chloroform, and HPB represents a volume fraction of heptane at a point of precipitation by the resin B as measured by the addition of heptane to a solution containing 0.01 mass parts of the resin B and 1.48 mass parts of chloroform.

The present invention also relates to a toner manufacturing method having either step (i) or step (ii) below:

(i) a step of granulating, in an aqueous medium, a polymerizable monomer composition containing the resin A, the resin B, the pigment and a vinyl polymerizable monomer capable of forming a binder resin, and polymerizing the vinyl polymerizable monomer contained in the polymerizable monomer composition to thereby manufacture a toner particle;

(ii) a step of granulating, in an aqueous medium, an organic solvent dispersion containing the resin A, the resin B and the pigment in an organic solvent, to thereby manufacture a toner particle.

A toner having both high tinting strength and durability is provided by the present invention, together with a manufacturing method therefor.

Further features of the present invention will become apparent from the following description of exemplary embodiments.

DESCRIPTION OF THE EMBODIMENTS

The toner and toner manufacturing method of the present invention are explained in detail below, but the present invention is not limited to these embodiments.

Unless otherwise specified, numerical ranges such as "at least A and not more than B" or "A to B" in the present invention include the minimum and maximum values at either end of the range.

The inventors discovered as a result of exhaustive research that the toner described above achieves the effects of the present invention.

The mechanism by which the effects of the present invention are achieved is thought to be as follows. The resin A used in the present invention has an acidic functional group, while the pigment has a structure derived from a basic compound. Pigment dispersibility is therefore improved and tinting strength enhanced due to acid-base interactions between the acidic resin A and the basic pigment.

Conventional pigment dispersants using acid-base interactions often have high acid values or amine values in order to improve interactivity with the pigment. When such a pigment dispersant is used, the pigment dispersion becomes highly polar in the toner, and is therefore likely to self-aggregate. This makes it harder to improve tinting strength.

It is also thought that when a polar resin with a high glass transition temperature (Tg) is used in combination with such a system in an effort to improve durability, the polar resin and the highly polar pigment dispersion are likely to interact, leading to uneven distribution of the polar resin around the pigment, and detracting from the dispersibility of the polar resin. Tg irregularities can occur within the toner as a result, sometimes causing reduced durability.

The resin A is characterized by having an acidic functional group and a high degree of hydrophobicity. Consequently, it is thought that using the resin A, in addition to the effect of the acidic functional group on pigment dispersion, self-aggregation of the pigment is suppressed and tinting strength is improved because the pigment dispersion becomes covered by hydrophobic groups. Moreover, HPA−HPB>0 in the present invention. Using a resin B with low hydrophobicity as a polar resin, this resin is unlikely to blend with the highly hydrophobic resin A, and the functions of the resin B can be obtained because it exists independently from the pigment. It is thought that durability is improved due to the presence of a resin B with a high Tg.

For these reasons, it is thought that the target effects are obtained in the present invention by using a highly hydrophobic resin A having an acidic functional group in combination with a resin B having low hydrophobicity and a specific acid value.

The materials of the toner of the present invention are explained in detail below.

The pigment having a structure derived from a basic compound in the present invention (hereunder called the "basic-treated pigment" or "treated pigment") is explained first. The basic-treated pigment is a pigment containing an organic dye (hereunder sometimes called a "treatment agent") having basic segments, or a pigment having a basic functional group.

A pigment containing an organic dye (treatment agent) having basic segments can be obtained for example by mixing the pigment with an organic dye (treatment agent) having basic segments. A pigment containing a basic functional group can be obtained for example by direct chemical modification of the pigment with a basic compound to partially basify the pigment. Either embodiment is possible, but a pigment containing an organic dye (treatment agent) having basic segments is preferred for ease of adjusting the base value of the pigment and ease of development into pigment types.

The organic dye (treatment agent) having basic segments preferably has a structure represented by Formula (2) below. This structure comprises a basic compound derived from an amino group, bound to an organic dye via an alkylene group.

(2)

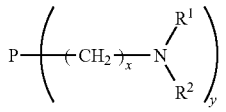

(In Formula (2), P is an organic dye, x is 1 or 2, y is a value of at least 1 and not more than 4, and each of $R^1$ and $R^2$ independently represents a hydrogen atom or linear or branched alkyl group, or a group needed for forming a (preferably $C_{3-6}$) heterocycle in which $R^1$ and $R^2$ bind together.)

P is an organic dye, and is preferably a structure adsorbable by the pigment. More preferably, P is an organic dye having a phthalocyanine skeleton or quinacridone skeleton. Specific examples include copper phthalocyanine, zinc phthalocyanine, 2,9-dimethylquinacridone, quinacridone and the like.

y represents the average number of basic segments bound to the organic dye (average per molecule of organic dye), and is at least 1 and not more than 4 (preferably at least 2 and not more than 4).

A structure in which each of $R^1$ and $R^2$ independently represents a hydrogen atom or $C_{1-4}$ linear or branched alkyl group, or $R^1$ and $R^2$ bind together to form a 5-member ring, is desirable for controlling steric hindrance and facilitating adsorption of the resin A. When $R^1$ and $R^2$ bind together to form a heterocycle, a nitrogen atom or oxygen atom may be included in the ring structure in addition to the N in Formula (2).

Specific examples of basic functional groups corresponding to $—NR^1R^2$ in Formula (2) above include an amino group as a primary amine, monomethylamino, monoethylamino, monopropylamino, monoisopropylamino, monobutylamino, monoisobutylamino, mono-tert-butylamino, monopentylamino and monohexylamino groups as secondary amines, and dimethylamino, diethylamino, dipropylamino, diisopropylamino, dibutylamino, diisobutylamino, di-tert-butylamino, dipentylamino, dihexylamino, methylethylamino, methylpropylamino, methylbutylamino, ethylpropylamino, ethylbutylamino, pyrrolidinyl, piperidinyl, piperadinyl, morpholino and pyrrolyl groups as tertiary amines.

The base dissociation constant (pKa) of the pigment is preferably at least 4.0 and not more than 7.0, and more preferably at least 4.5 and not more than 6.5. pKa is a base dissociation constant measured by preparing a pigment dispersion in which 10.0 mass parts of the pigment, 140.0 mass parts of toluene and 60.0 mass parts of ethanol are mixed, and then subjecting to neutralization titration with a 0.1 mol/L hydrochloric acid ethanol solution. The specific measurement method will be described later.

If the pKa is at least 4.0, tinting strength, durability and heat-resistant storability are easily improved because interactions between the treatment agent and the resin B are controlled. If the pKa is not more than 7.0, tinting strength is more easily improved because the pigment is more easily adsorbed by the resin A. Moreover, $—NR^1R^2$ in Formula (2) is preferably a tertiary amine because this makes it easier to maintain the pKa of the treatment agent within the range of at least 4.0 and not more than 7.0, so that interactions between the treatment agent and the resin B are controlled and the resin A is more easily adsorbed.

For these reasons, the treatment agent used in the present invention preferably has a structure represented by Formula (2), and the basic functional group corresponding to $—NR^1R^2$ preferably has a $C_{1-4}$ dialkylamine structure or $C_{3-6}$ cyclic amine structure. In this case, the pKa of the basic-treated pigment is controlled within the desired range, and because adsorption of the resin A is not inhibited by steric hindrance, tinting strength, durability and heat-resistant storability are easily improved.

Thus, the pigment having a structure derived from a basic compound may be a pigment having a basic functional group. The basic functional group is preferably represented by Formula (8) below:

(8)

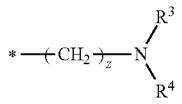

In Formula (8), * represents a segment binding to the pigment, z is 1 or 2, and each of $R^3$ and $R^4$ independently represents a hydrogen atom or linear or branched alkyl group, or a group needed for forming a (preferably $C_{3-6}$) heterocycle in which $R^3$ and $R^4$ bind together.

Preferred embodiments of $R^3$ and $R^4$ are similar to those given for $R^1$ and $R^2$ above. Embodiments of the group corresponding to —$NR^3R^4$ are similar to those given for the functional group corresponding to —$NR^1R^2$. The pigment having a basic functional group can be obtained for example by direct chemical modification of the pigment with a basic compound that partially basifies the pigment. As a specific method, basified copper phthalocyanine can be obtained by reacting a phthalocyanine pigment in concentrated sulfuric acid with paraformaldehyde and phthalimide.

The pigment having a structure derived from a basic compound is preferably a pigment containing an organic dye (treatment agent) having basic segments. Pigments that can be used in the basic-treated pigment include the conventional known pigments listed below.

Examples of black pigments include carbon black.

Examples of yellow pigments include condensation pigments, and compounds such as isoindolinone compounds, anthraquinone compounds, azo metal complex methine compounds and allylamide compounds. More specific examples include C.I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193 and 199.

Examples of magenta pigments include condensation pigments, diketopyrrolopyrrole compounds, anthraquinone compounds, quinacridone compounds, basic dye lake compounds, naphthol compounds, benzimidazolone compounds, thioindigo compounds and peryline compounds. More specific examples include C.I. Pigment Red 2, 3, 5, 6, 7, 23, 48:2, 48:3, 48:4, 57:1, 81:1, 122, 146, 150, 166, 169, 177, 184, 185, 202, 206, 220, 221, 238, 254, 269, and C.I. Pigment Violet 19.

Examples of cyan pigments include phthalocyanine compounds, derivatives of phthalocyanine compounds, anthraquinone compounds and basic dye lake compounds. More specific examples include C.I. Pigment Blue 1, 7, 15, 15:1, 15:2, 15:3, 15:4, 60, 62 and 66.

One of these pigments or two or more thereof may be mixed with the treatment agent.

The content of the pigment is preferably at least 4 mass % and not more than 20 mass % of the toner particle.

In the present invention, the base value of the pigment is preferably at least 0.9 mg KOH/g and not more than 3.0 mg KOH/g, or more preferably at least 1.3 mg KOH/g and not more than 2.5 mg KOH/g. If the base value is at least 0.9 mg KOH/g, pigment dispersibility is improved and tinting strength is more easily improved because the absolute amount of the treatment agent is sufficient. If it is not more than 3.0 mg KOH/g, on the other hand, durability and heat-resistant storability are easily improved because it is easy to control interactions with the resin B while maintaining adequate tinting strength. The base value of the basic-treated pigment can be controlled by adjusting the added amount of the treatment agent. The method of measuring base value is described below.

The method of manufacturing the treatment agent in the present invention is not particularly limited, and it can be obtained by a conventional known method. Specifically, the manufacturing methods described in Japanese Patent No. 4484171 may be applied to manufacturing the treatment agent of the present invention.

Next, the resin A used in the present invention is explained in detail.

The resin A in the present invention is characterized by having a hydrophobic parameter HPA of at least 0.60. If the HPA is at least 0.60, interactions with the resin B and the basic-treated pigment can be controlled for the reasons described above because hydrophobicity is sufficiently high, and good tinting strength, heat-resistant storability and durability can be achieved simultaneously. The HPA can be controlled principally by changing the composition of the resin A.

The HPA is the volume fraction of heptane at the point of precipitation by the resin A as measured by the addition of heptane to a solution containing 0.01 mass parts of the resin A and 1.48 mass parts of chloroform.

The HPA is preferably at least 0.65. There is no particular upper limit, but preferably it is not more than 0.98, or more preferably not more than 0.95.

The resin A has an acidic functional group. When the resin A has an acidic functional group, the acidic functional group interacts with the structure derived from a basic compound, conferring strong adsorbability by the pigment, so that good tinting strength, heat-resistant storability and durability can all be achieved simultaneously. A carboxyl group, sulfo group, phosphoric acid group, phenolic hydroxy group or the like can be used as the acidic functional group.

Of these acidic functional groups, a carboxyl, sulfo or phosphoric acid group is preferred because it is highly acidic and advantageous for adsorption by the basic-treated pigment. A carboxyl or sulfo group is preferred from the standpoint of ease of manufacture and stability of the resin.

The resin A preferably has a structure represented by Formula (3) below.

(3)

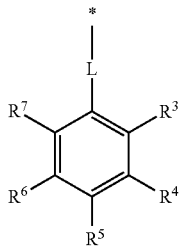

(In Formula (3), either $R^4$ or $R^5$ is a carboxyl group, while each of the $R^3$, $R^4$, $R^5$, $R^6$ and $R^7$ other than the carboxyl group independently represents a hydrogen atom, hydroxy group, amino group, $C_{1-8}$ alkoxy group or $C_{1-8}$ alkyl group, L is a linking group represented by Formula (4), and * is a segment binding to a main chain skeleton of the resin A.)

(4)

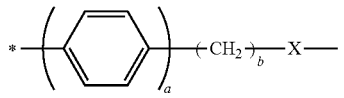

(In Formula (4), a is 0 or 1, b is an integer that is at least 0 and not more than 4, X is a single bond or a group represented by —O—, —S— or —$NR^8$—, $R^8$ is a hydrogen atom or $C_{1-4}$ alkyl group, and * is a segment binding to the main chain skeleton of the resin A.)

The carboxyl group in Formula (3) is a segment that is adsorbed to the pigment having a structure derived from a basic compound as described above, and is preferably either $R^4$ or $R^5$. If it is either $R^4$ or $R^5$, steric hindrance can be reduced when the resin is adsorbed because there is more distance between the segment and the main chain skeleton of the resin A. When $C_{1-8}$ alkoxy groups or $C_{1-8}$ alkyl groups are used as the groups other than the carboxyl group, $C_{1-4}$ alkoxy groups or $C_{1-4}$ alkyl groups are preferred from the standpoint of steric hindrance when the resin is adsorbed.

The a in Formula (4) is preferably 1. When a is 1, adsorbability to the pigment can be easily improved because the distance between the adsorbed segment and the main chain skeleton can be controlled at a suitable distance. For similar reasons, b is preferably at least 1 and not more than 4. When X is —O—, adsorbability can be improved because interactions involving hydrogen bonds are likely to operate in addition to acid-base interactions.

The partial structure represented by Formula (3) is preferably a partial structure represented by Formula (5) below.

(5)

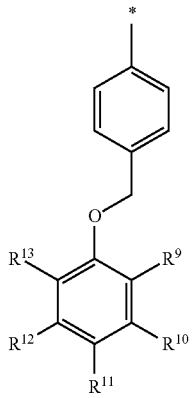

In Formula (5), one of $R^{10}$ and $R^{11}$ is a carboxyl group, while the other is a hydroxy group, each of $R^9$, $R^{12}$ and $R^{13}$ independently represents a hydrogen atom, hydroxy group, amino group, $C_{1-4}$ alkoxy group or $C_{1-4}$ alkyl group, and * is a segment binding to the main chain skeleton of the resin A. Preferably the resin A has a partial structure represented by Formula (3) (preferably by Formula (5)) in the side chain.

For the reasons discussed above, when the partial structure represented by Formula (3) above is the partial structure represented by Formula (5), adsorbability by the pigment having a structure derived from a basic compound is likely to improve, and it is easy to simultaneously achieve good tinting strength, heat-resistant storability and durability.

The main chain skeleton of the resin A may be any kind of polymer. Examples include vinyl polymers, polyester polymers, polyamide polymers, polyurethane polymers and polyether polymers. Of these, a vinyl polymer or polyester polymer is preferred from the standpoint of ease of manufacture.

A vinyl polymer is preferred from the standpoint of ease of hydrophobic parameter control. When a vinyl polymer is used as the resin A in the present invention, it can be obtained for example by copolymerizing a vinyl monomer with a compound having an introduced polymerizable functional group such as that represented by Formula (A) below, or by introducing an acidic function group post-facto into a polymer previously obtained by co-polymerizing monomers derived from the main chain skeleton.

(A)

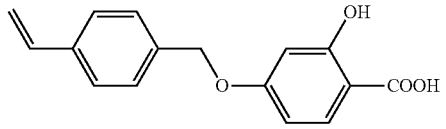

When a vinyl polymer is used as the resin A, the structure represented by Formula (3), for example, is preferably represented by Formula (3-1) below.

(3-1)

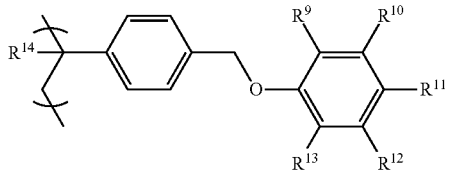

(In Formula (3-1), $R^9$ to $R^{13}$ are as described above, and $R^{14}$ is a hydrogen atom or methyl group.)

The vinyl monomer used for resin A is not particularly limited. Specifically, the following vinyl polymers are preferably used as monomers in the main chain skeleton of the resin A:

aromatic vinyl monomers such as styrene, o-methylstyrene, m-methylstyrene, p-methylstyrene and α-methylstyrene; unsaturated monoolefin monomers such as ethylene, propylene, butylene and isobutylene; halogenated vinyl monomers such as vinyl chloride, vinylidene chloride, vinyl bromide and vinyl fluoride; vinyl ester acid monomers such as vinyl acetate, vinyl propionate and vinyl benzoate; acrylic acid monomers such as acrylic acid, methyl acrylate, ethyl acrylate, propyl acrylate, butyl acrylate, 2-ethylhexyl acrylate, octyl acrylate, dodecyl acrylate, stearyl acrylate, behenyl acrylate, hydroxyethyl acrylate, hydroxypropyl acrylate, glycidyl acrylate and benzyl acrylate; and methacrylic acid monomers such as methacrylic acid, methyl methacrylate, ethyl methacrylate, propyl methacrylate, butyl methacrylate, 2-ethylhexyl methacrylate, octyl methacrylate, dodecyl methacrylate, stearyl methacrylate, behenyl methacrylate, hydroxyethyl methacrylate, hydroxypropyl methacrylate, glycidyl methacrylate and benzyl methacrylate. One of these monomers may be used alone, or two or more may be used in combination.

A composite polymer comprising a polyester structure and a vinyl copolymer structure is also possible as the main chain skeleton of the resin A. Specific examples include composite polymers obtained by grafting vinyl polymer structures to polyester main chains, and composite polymers having structures obtained by binding blocks of polyester structures and vinyl polymer structures together.

Resin A preferably also has an alkoxycarbonyl group represented by Formula (6) below. This makes it easier to control the HPA at 0.60 or more.

(6)

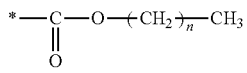

In this case, n is preferably at least 3 and not more than 21. If n is at least 3, the effect of raising the hydrophobicity of resin A is great, and it is easy to improve tinting strength, durability and heat resistance. If n is not more than 21, it is easy to improve tinting strength, durability and heat resistance because adsorption of resin A by the basic-treated pigment is not inhibited. * represents a segment binding to the main chain skeleton of the resin A.

A $C_{3-21}$ alkyl ester of acrylic acid or methacrylic acid is preferred as a monomer containing an alkoxycarbonyl group, from which the structure of Formula (6) is derived. Examples include butyl acrylate, stearyl acrylate, behenyl acrylate, butyl methacrylate, stearyl methacrylate and behenyl methacrylate. The content of monomer units containing the structure of Formula (6) is preferably at least 2 mol % and not more than 12 mol % as a percentage of the total monomer units constituting the resin A.

The weight-average molecular weight (Mw) of the resin A is preferably at least 10,000 and not more than 75,000, or more preferably at least 10,000 and not more than 55,000. If the Mw is at least 10,000, the excluded volume effect acts sufficiently to promote dispersion of the pigment, and tinting strength is easily improved. If the Mw is not more than 75,000, it is easy to improve tinting strength, heat-resistant storability and durability because adsorption to the pigment is not inhibited. The Mw of the resin A can be controlled by altering the reaction temperature, reaction time, percentage content of the monomers and amount of the initiator and the like during polymerization.

The acid value of the resin A is preferably at least 3.0 mg KOH/g and not more than 25.0 mg KOH/g, or more preferably at least 5.0 mg KOH/g and not more than 20.0 mg KOH/g. If the acid value is at least 3.0 mg KOH/g, the tinting strength, heat-resistant storability and durability can be easily improved because there are more points of adsorption by the pigment having a structure derived from a basic compound. If the acid value is not more than 25.0 mg KOH/g, tinting strength is improved because pigment-pigment crosslinking can be controlled. The acid value of the resin A can be controlled by altering the composition and molecular weight.

The content of the resin A in the present invention is preferably at least 1.0 mass part and not more than 30.0 mass parts, or more preferably at least 5.0 mass parts and not more than 25.0 mass parts per 100 mass parts of the pigment. If the content is at least 1.0 mass part, tinting strength, heat-resistant storability and durability are easily improved because a sufficient amount of the resin A can be adsorbed to the pigment. If it is not more than 30.0 mass parts, tinting strength is easily improved because it is possible to control pigment aggregation due to increased polarity of the system caused by components not adsorbed to the pigment.

The resin B is explained in detail next.

The resin B in the present invention is characterized by an acid value of at least 2.0 mg KOH/g. It is thought that if the acid value is at least 2.0 mg KOH/g, phase separation is more likely to occur with a wax or other resin during toner manufacture, improving dispersibility within the toner. Moreover, it appears that the resin is more likely to be distributed near the surface level of the particle when the particle is formed by granulation in an aqueous medium, thereby improving durability and heat-resistant storability. The acid value of the resin B is preferably at least 2.5 mg KOH/g. There is no particular upper limit, but preferably the acid value is not more than 30.0 mg KOH/g, or more preferably not more than 25.0 mg KOH/g. The acid value of the resin B can be controlled by altering the composition of the resin B.

The resin B is characterized by a glass transition temperature TgB of at least 50° C. If the TgB is at least 50° C., durability and heat-resistant storability are improved. There is no particular upper limit, but preferably the TgB is not more than 120° C., or more preferably not more than 100° C. The TgB can be controlled by altering the molecular weight and composition.

The resin B is characterized by a hydrophobic parameter HPB of not more than 0.70. It is thought that if the HPB is not more than 0.70, tinting strength, durability and heat-resistant storability are improved because interactions with the pigment can be controlled for the reasons given above. The HPB is preferably not more than 0.60. There is no particular lower limit, but preferably the HPB is at least 0.30, or more preferably at least 0.40. The HPB can be controlled principally by altering the composition of the resin B.

The HPB represents the volume fraction of heptane at the precipitation point of the resin B as measured upon addition of heptane to a solution containing 0.01 mass parts of the resin B and 1.48 mass parts of chloroform.

The resin B is preferably used in an amount that does not greatly detract from the low-temperature fixability and other electrophotographic characteristics, and is preferably used in the amount of at least 0.50 mass % and not more than 30.0 mass % of the total mass of the toner particle.

The HPA and HPB preferably satisfy the following Formula (7) in the present invention.

$$HPA-HPB \geq 0.05 \quad (7)$$

When the HPA and HPB satisfy Formula (7) above, tinting strength, durability and heat-resistant storability are easily improved because interactions can be better controlled due to the large difference between the hydrophobicities of the resin A and resin B. HPA−HPB is more preferably at least 0.10. There is no particular upper limit, but preferably the difference is not more than 0.50, or more preferably not more than 0.40.

The content of the resin A is preferably at least 1.0 mass part, or more preferably at least 5.0 mass parts and not more than 70.0 mass parts per 100 mass parts of the resin B. If the content is at least 1.0 mass part, tinting strength, durability and heat-resistant storability can be easily improved because it is easier to control interactions between the resin B and the pigment.

Any resin may be used as long as the resin B falls within the above defined range. Examples include vinyl resins, polyester resins, polyamide polymers, polyurethane polymers and polyether polymers.

Of these, a vinyl resin or polyester resin is preferred for ease of manufacture and ease of adjusting the various parameters.

A vinyl resin is a resin obtained by polymerizing a vinyl polymerizable monomer capable of radical polymerization. Specifically, the following monomers can be used.

Examples of vinyl monomers include styrene, and styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphate ethyl acrylate, diethylphosphate ethyl acrylate, dibutylphosphate ethyl acrylate and 2-benzoyloxy ethyl acrylate; and methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphate ethyl methacrylate and dibutylphosphate ethyl methacrylate.

Examples of polyfunctional polymerizable monomers include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylol propane triacrylate, tetramethylol methane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylol propane trimethacrylate, tetramethylol methane tetramethacrylate, divinyl benzene, divinyl naphthalene and divinyl ether.

These may be used alone, or two or more may be used in combination.

The polyester resin is obtained by condensing a polyvalent carboxylic acid with a polyhydric alcohol. Specifically, the following polyvalent carboxylic acids and polyhydric alcohols may be used.

Examples of polyvalent carboxylic acids include oxalic acid, glutaric acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-carboxylic acid, hexahydroterephthalic acid, malonic acid, pimelic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid and cyclohexane dicarboxylic acid. Examples of polyvalent carboxylic acids other than dicarboxylic acids include trimellitic acid, pyromellitic acid, naphthalene tricarboxylic acid, naphthalene tetracarboxylic acid, pyrenetricarboxylic acid and pyrenetetracarboxylic acid.

Examples of polyols include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylol ethane, trimethylol propane, 1,3,5-trihydroxymethylbenzene, bisphenol A, bisphenol A ethylene oxide adduct, bisphenol A propylene oxide adduct, hydrogenated bisphenol A, hydrogenated bisphenol A ethylene oxide adduct, and hydrogenated bisphenol A propylene oxide adduct.

The toner of the present invention may be manufactured by conventional known methods. Preferred methods include for example a suspension polymerization method in which a polymerizable monomer composition containing a polymerizable monomer for producing a binder resin, a resin A, a resin B, and a pigment dispersion containing a basic treated pigment, together with a release agent or the like as necessary, is suspended and granulated in an aqueous medium, and the polymerizable monomer contained in the polymerizable monomer composition is polymerized; a kneading pulverization method in which various toner-forming materials including a basic-treated pigment, a resin A and a resin B are kneaded, pulverized and classified; an emulsion aggregation method in which a dispersion of an emulsified and dispersed binder resin, a pigment dispersion containing a resin A together with a basic-treated pigment, and a dispersion containing a resin B, are mixed together with a dispersion of a release agent or the like as necessary, aggregated, and heat fused to obtain a toner particle; an emulsion polymerization and aggregation method in which a dispersion formed by emulsion polymerization of the polymerizable monomer of a binder resin, a pigment dispersion containing a resin A together with a basic-treated pigment, and a dispersion containing a resin B are mixed together with a dispersion of a release agent or the like as necessary, and then aggregated and heat fused to obtain a toner particle; and a dissolution suspension method in which an organic solvent dispersion containing a binder resin, a resin A, a resin B, and a pigment dispersion containing a basic-treated pigment in an organic solvent is suspended in an aqueous medium together with a solution of a release agent or the like as necessary, and granulated.

The resin A is preferably added in the step of manufacturing the pigment dispersion because this makes it easier to improve adsorbability to the pigment and achieve good pigment dispersibility.

In particular, with a manufacturing method having a step of uniformly mixing a toner composition in an oil phase, the dispersibility of the pigment in the toner is improved because the resin A, resin B and pigment are mixed uniformly. Therefore, a suspension polymerization method or dissolution suspension method is preferred. That is, a manufacturing method comprising either step (i) or step (ii) below is preferred in the present invention:

(i) a step of granulating, in an aqueous medium, a polymerizable monomer composition containing a vinyl polymerizable monomer, the resin A, the resin B and the pigment, and then polymerizing the vinyl polymerizable monomer contained in the polymerizable monomer composition to thereby manufacture a toner particle;

(ii) a step of granulating, in an aqueous medium, an organic solvent dispersion containing the resin A, the resin B and the pigment in an organic solvent, to thereby manufacture a toner particle.

The toner of the present invention may also contain a release agent. Examples of the release agent include aliphatic hydrocarbon waxes such as low-molecular-weight polyethylene, low-molecular-weight polypropylene, microcrystalline wax and paraffin wax; aliphatic hydrocarbon wax oxides such as polyethylene oxide wax; block copolymers of aliphatic hydrocarbon waxes; waxes consisting primary of fatty acid esters, such as carnauba wax, sasol wax and montanic acid ester wax; partially or fully deoxidized fatty acid esters, such as deoxidized carnauba wax; partial esterification products of fatty acids and polyhydric alcohols, such as behenic acid monoglyceride; and methyl ester compounds with hydroxy groups obtained by hydrogenation of plant-based oils and fats.

The content of the release agent in the toner particle is preferably at least 3 mass % and not more than 12 mass %.

The toner of the present invention may also contain a charge control agent. A conventional known charge control agent may be used as the charge control agent in the toner of the present invention. Examples of negative charge control agents include metal compounds of aromatic carboxylic acids such as salicylic acid, alkylsalicylic acid, dialkylsalicylic acid, naphthoic acid and dicarboxylic acid; polymers or copolymers having sulfonic acid groups, sulfonate groups or sulfonic acid ester groups; metal salts or metal complexes of azo dyes or azo pigments; and boron compounds, silicon compounds and calixarenes. Examples of positive charge control agents include quaternary ammonium salts and polymeric compounds having quaternary ammonium salts in the side chains; guanidine compounds; nigrosine compounds; and imidazole compounds. Monopolymers of vinyl monomers containing sulfonic acid groups, such as styrenesulfonic acid, 2-acrylamido-2-methylpropane sulfonic acid, 2-methacrylamido-2-methylpropane sulfonic acid, vinylsulfonic acid and methacrylsulfonic acid, or copolymers of vinyl monomers with these vinyl monomers having sulfonic acid groups, can be used as the polymers or copolymers having sulfonate groups or sulfonic acid ester groups.

The content of the charge control agent in the toner particle is preferably at least 0.1 mass % and not more than 5 mass %.

In the present invention, an external additive may be added externally to the toner particle to improve the image quality of the toner. Inorganic fine particles such as silica fine particles, titanium oxide fine particles or aluminum oxide fine particles can be used favorably as the external additive. These inorganic fine particles have preferably been hydrophobically treated with a silane coupling agent, silicone oil or a mixture of these as a hydrophobizing agent. An external additive other than those described above may also be mixed with the toner particle as necessary in the toner of the present invention.

In addition to the materials described above, the toner of the present invention may also contain a resin (binder resin) for binding the various materials. A known resin such as a vinyl resin, maleic acid copolymer, polyester resin or epoxy resin may be used as the binder resin. Of these, vinyl resins and polyester resins are preferred from the standpoint of ease of manufacture. Those discussed above with reference to the resin B may be used as monomers of the vinyl resin or polyester resin.

The methods of evaluating the various physical properties in the present invention are explained next.

(Method for Measuring Hydrophobic Parameters HPA and HPB)

The hydrophobic parameters HPA and HPB are measured as follows.

0.01 g of the resin A is weighed into a 8 mL sample jar and dissolved in 1.48 g (1.0 mL) of chloroform, and the initial mass (W1) is measured. A stir bar is placed in the sample jar, and the mixture is stirred with a magnetic stirrer while:

(a) 100 mg of heptane is added dropwise, and stirring is continued for 20 seconds; and (b) white turbidity is confirmed with the naked eye.

If there is no white turbidity, operations (a) and (b) are repeated. Once white turbidity is confirmed (precipitation point), the operation is stopped, and the mass (W2) is measured. All measurements are performed at 25° C., normal pressure (1 atmosphere).

The HPA is calculated by the following formula. At 25° C., 1 atmosphere, the specific gravity of heptane is 0.684, and that of chloroform is 1.48.

$$HP=\{(W2-W1)/0.684\}/\{[(W2-W1)/0.684]+1\}$$

The same measurement is performed three times, and the average value given as the HPA.

The HPB is measured in the same way by substituting resin B for resin A in the measurement method described above.

(Method for Measuring Weight-Average Molecular Weight and Number-Average Molecular Weight of Resin a and Resin B)

The weight-average molecular weight (Mw) and number-average molecular weight (Mn) were measured as follows by gel permeation chromatography (GPC).

First, resin A or resin B is dissolved at room temperature in tetrahydrofuran (THF). The resulting solution is then filtered with a 0.2 μm pore diameter solvent-resistant membrane filter "Sample Pretreatment Cartridge" (Tosoh Corporation) to obtain a sample solution. The concentration of THF-soluble components in the sample solution is adjusted to 0.8 mass %. Measurement is performed under the following conditions using this sample solution.

Equipment: High-speed GPC unit "HLC-8220GPC" (Tosoh Corporation)

Columns: LF-604×2 (Showa Denko K.K.)

Eluent: THF

Flow rate: 0.6 mL/minute

Oven temperature: 40° C.

Sample injection volume: 0.020 mL

A molecular weight calibration curve prepared using standard polystyrene resin (for example product name "TSK Standard Polystyrene F-850, F-450, F-288, F-128, F-80, F-40, F-20, F-10, F-4, F-2, F-1, A-5000, A-2500, A-1000, A-500" (Tosoh Corporation)) is used for calculating the molecular weight of each sample.

(Method for Measuring Glass Transition Temperature (Tg))

The glass transition temperature (Tg) is measured using a differential scanning calorimeter "Q1000" (TA Instruments) in accordance with ASTM D3418-82.

The melting points of indium and zinc are used for temperature correction of the device detection part, and the heat of fusion of indium is used for correction of the calorific value. Specifically, 2 mg of a measurement sample of resin B or the like is weighed and placed in an aluminum pan, and using an empty aluminum pan for reference, the temperature is raised at a rate of 10° C./minute within the measurement range of 0° C. to 150° C. The sample is held for 15 minutes at 100° C., and then cooled from 100° C. to 0° C. at a rate of 10° C./minute. It is then held for 10 minutes at 0° C., and measured between 0° C. and 100° C. at a rate of temperature increase of 10° C./minute.

The glass transition temperature (Tg) is taken to be the temperature at the point of intersection between the curve of the stepwise change part of the glass transition and a straight line longitudinally equidistant from the extended straight lines of the baselines prior to and subsequent to the appearance of the change in specific heat in the specific heat change curve during the second temperature increase.

(Method for Measuring Weight-Average Particle Diameter (D4) of Toner Particle and Toner)

The weight-average particle diameters (D4) of the toner particle and toner are measured using a precise particle size analyzer "Coulter Counter Multisizer 3 (registered trademark)" (Beckman Coulter, Inc.). Measurement is performed under the following conditions.

Effective measurement channels: 25,000
Total number of control motors: 50,000
Aperture: 100 μm
Current: 1600 μA
Gain: 2

Measurement is performed using a Kd value obtained with "standard particles 10.0 μm" (Beckman Coulter, Inc.).

The measurement data are analyzed with the dedicated software attached to the apparatus, to calculate the weight-average particle diameter (D4). The weight-average particle diameter (D4) is the "average diameter" on the "analysis/volume statistical value (arithmetic average)" screen when graph/vol % is set by the dedicated software.

(Pigment Structure)

The structure of the pigment, such as the number of basic segments bound to the organic dye, is analyzed by nuclear magnetic resonance spectroscopy ($^1$H-NMR).

Measurement equipment: JNM-EX400 (JEOL Ltd.)
Measurement frequency: 400 MHz
Pulse conditions: 5.0 μs
Frequency range: 10,500 Hz
Cumulative number: 1024
Measurement solvent: DMSO-d6

The sample is dissolved as much as possible, and measurement performed under the above conditions. The structure of the treatment agent and the average number of basic segments introduced into the base skeleton are calculated from the proton ratio and chemical shift value of the resulting spectrum.

(Method for Measuring Base Value and pKa of Pigment)

The base value of the pigment is the number of mg of potassium hydroxide equivalent to hydrochloric acid needed to neutralize the base contained in 1 g of the sample. The base value of the pigment is measured as follows.

Titration is performed using a 0.1 mol/L hydrochloric acid ethanol solution. The 0.1 mol/L hydrochloride acid is prepared in accordance with JIS K 8001-1998.

The measurement conditions for base value measurement are as follows.

Titration unit: potentiometric titrator AT-510 (Kyoto Electronics Manufacturing Co., Ltd.)
Electrodes: Composite glass electrode double-junction type (Kyoto Electronics Manufacturing Co., Ltd.)
Control software for titration unit: AT-WIN
Titration analysis software: Tview The titration parameters and control parameters for titration are set as follows.

(Titration Parameters)
Titration mode: Blank titration
Titration format: Full-volume titration
Maximum titer: 20 mL
Waiting time before titration: 30 seconds
Titration direction: Automatic
(Control Parameters)
End point judgment potential: 30 dE
End point judgment potential value: 50 dE/dmL
End point detection judgment: Not set
Control speed mode: Standard
Gain: 1
Data sampling potential: 4 mV
Data sampling titer: 0.1 mL
(Main Test)

10.0 g of pigment and 200.0 g of a (7:3) mixed solution of 140.0 g of toluene and 60.0 g of ethanol are placed in a pressure-resistant container together with 250 g of 0.8 mm glass beads, and the pigment is dispersed for 5 hours with a paint shaker (Toyo Seiki Seisaku-sho, Ltd.) to obtain a pigment dispersion. 100.0 g of this pigment dispersion is then weighed into a tall beaker.

This is then titrated with the aforementioned hydrochloric acid ethanol solution using the aforementioned potentiometric titrator.

(Blank Test)

Titration is performed by the same operations except that no sample is used (that is, using only a mixed solution of 140.0 g of toluene and 60.0 g of ethanol).

(Calculating Base Value)

The results were entered into the following formula to calculate the base value:

$$BV=[(C-B)\times f\times 5.611]/S$$

(in the formula, BV is the base value (mg KOH/g), B is the added amount (mL) of the hydrochloric acid ethanol solution in the blank test, C is the added amount (mL) of the hydrochloric acid ethanol solution in the main test, f is the factor of a potassium hydroxide solution, and S is the sample (g)).

(Determining pKa)

The point at which the pH change gradient is the greatest in the titration curve obtained by base value measurement is taken as the neutralization point. The pKa of the pigment is determined as follows. The pH at half the amount of 0.1 mol/L hydrochloric acid ethanol solution required up to the neutralization point is read from the titration curve, and this pH value is given as the pKa. However, the pH at the beginning of titration is given as the pKa in cases in which the base value is less than 0.1 and the neutralization point is difficult to determine.

(Method for Measuring Acid Value)

The acid value is the number of mg of potassium hydroxide needed to neutralize the acid contained in 1 g of sample. The acid value of the resin A and the resin B are measured in accordance with JIS K 0070-1992, and specifically is measured by the following procedures.

(1) Preparation of Sample 1.0 g of phenolphthalein is dissolved in 90 mL of ethanol (95 vol %), and ion-exchange water is added up to a total of 100 mL to obtain a phenolphthalein solution.

7 g of special-grade potassium hydroxide is dissolved in 5 mL of water, and ethanol (95 vol %) is added to a total of 1 L. Avoiding contact with carbon dioxide gas and the like, this is placed in an alkali-resistant container and left standing for 3 days, and then filtered to obtain a potassium hydroxide solution. The resulting potassium hydroxide solution is stored in an alkali-resistant container. The factor of the potassium hydroxide solution is determined by taking 25 mL of 0.1 mol/L hydrochloric acid in a conical flask, adding a few drops of the previous phenolphthalein solution, titrating this with the potassium hydroxide solution, and measuring the amount of the potassium hydroxide solution required for neutralization. The 0.1 mol/L hydrochloride acid is prepared in accordance with JIS K 8001-1998.

(2) Operations (A) Main Test 2.0 g of the resin B or the resin A is weighed into a 200 mL conical flask, 100 mL of a toluene/ethanol (2:1) mixed solution is added, and the resin is dissolved for 5 hours. A few drops of the previous phenolphthalein solution are added as an indicator, followed by titration with the previous potassium hydroxide solution. The end of titration is the point at which the light pink color of the indicator has persisted for about 30 seconds.

(B) Blank Test

Titration is performed by the same operations except that no sample is used (that is, using only a mixed toluene/ethanol (2:1) solution).

(3) The Results are Entered into the Following Formula to Calculate the Acid Value.

$$A=[(C-B)\times f\times 5.61]/S$$

In the formula, A is the acid value (mg KOH/g), B is the amount (mL) of the potassium hydroxide solution added in the blank test, C is the amount (mL) of the potassium hydroxide solution added in the main test, f is the factor of the potassium hydroxide solution, and S is the sample (g).

EXAMPLES

The present invention is explained in detail below using examples, but the present invention is not limited to these examples. Unless otherwise specified, "parts" and "%" values in the text are all based on mass.

(Manufacture of Basic-Treated Pigment)

A basic-treated pigment was manufactured according to the manufacturing methods described in Japanese Patent No. 4484171.

(Manufacture of Treatment Agent 1)

91.4 parts of 98% sulfuric acid, 36.7 parts of 25% fuming sulfuric acid, 6.3 parts of diethylamine and 2.8 parts of 92% paraformaldehyde were loaded at 40° C. into a reaction vessel equipped with a stirrer, a condenser, a thermometer and a nitrogen introduction tube. This was stirred for 30 minutes at 40° C., after which 8.0 parts of copper phthalocyanine were slowly added. After addition, the reaction solution was warmed, and a reaction was performed for 5 hours at 80° C. After completion of the reaction, the reaction solution was cooled to room temperature and transferred to 750 parts of water, and the slurry was filtered out, water washed and dried to obtain a treatment agent 1 having introduced diethylaminomethyl groups.

When the resulting treatment agent 1 was analyzed by NMR, an average of 2.1 diethylaminomethyl groups were found to have been introduced. The physical properties of the treatment agent 1 are shown in Table 1.

(Manufacture of Treatment Agents 2 to 5)

The treatment agents 2 to 5 shown in Table 1 were manufactured by the same methods as treatment agent 1 except that the structure of the amine compound and the base skeleton were changed.

TABLE 1

| | Structure | y (average number) |
|---|---|---|
| Treatment agent 1 | 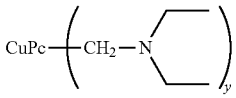 | 2.1 |
| Treatment agent 2 | 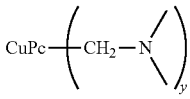 | 2.0 |
| Treatment agent 3 | 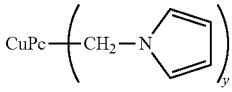 | 2.5 |
| Treatment agent 4 | 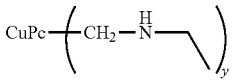 | 1.9 |
| Treatment agent 5 | 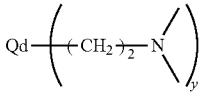 | 2.2 |

In Table 1, CuPc in the structure represents copper phthalocyanine and Qd represents 2,9-dimethylquinacridone.

(Manufacture of Basic-Treated Pigment 1)

2.0 mass parts of the treatment agent 1 were added to C.I. Pigment Blue 15:3 (100 mass parts), and mixed by shaking for 24 hours to prepare a basic-treated pigment 1. The physical properties of the resulting basic-treated pigment 1 are shown in Table 2.

(Manufacture of Basic-Treated Pigments 2 to 10)

The basic-treated pigments 2 to 10 shown in Table 2 below were manufactured by the same methods as the basic-treated pigment 1 except that the type of treatment agent, the type of pigment and the respective mixing ratios were changed appropriately.

TABLE 2

| Basic-treated pigment No. | Treatment agent No. | Treatment agent amount (parts) | Pigment | Pigment amount (parts) | Pigment pKa | Base value of basic-treated pigment (mg KOH/g) |
|---|---|---|---|---|---|---|
| 1 | 1 | 2.0 | PB15:3 | 100.0 | 5.5 | 1.49 |
| 2 | 2 | 2.0 | PB15:3 | 100.0 | 5.7 | 1.47 |
| 3 | 3 | 2.0 | PB15:3 | 100.0 | 4.4 | 1.51 |
| 4 | 4 | 2.0 | PB15:3 | 100.0 | 6.6 | 1.48 |
| 5 | 1 | 2.0 | CB | 100.0 | 5.5 | 1.49 |
| 6 | 5 | 2.0 | PR122 | 100.0 | 5.6 | 1.47 |
| 7 | 1 | 1.0 | PB15:3 | 100.0 | 5.5 | 0.95 |
| 8 | 1 | 0.3 | PB15:3 | 100.0 | 5.5 | 0.50 |
| 9 | 1 | 4.0 | PB15:3 | 100.0 | 5.5 | 2.80 |
| 10 | 1 | 5.0 | PB15:3 | 100.0 | 5.5 | 3.50 |

In the Table, PB15:3 represents Pigment Blue 15:3, CB represents carbon black, and PR122 represents Pigment Red 122.

Synthesis of Resin A

The resin A was synthesized by the following procedures.

Synthesis Example of Compound C1

78.6 g of 2,4-dihydroxybenzoic acid were dissolved in 400 mL of methanol, 152.0 g of potassium carbonate were added, and the mixture was heated to 60° C. A solution of 87.9 g of 4-(chloromethyl)styrene mixed and dissolved in 100 mL of methanol was added dropwise to this reaction solution, which was then reacted for 2.5 hours at 60° C. The resulting reaction solution was cooled, filtered, and washed with methanol.

The resulting precipitate was dispersed in 1 L of pH 1 water with hydrochloric acid. This was then filtered, water washed, and dried at 80° C. to obtain 55.7 g of the compound C1 represented by the following formula.

Compound C1

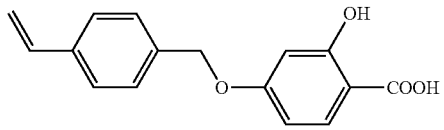

Synthesis Example of Compound C2

100.0 g of 2,5-dihydroxybenzoic acid was dissolved in 2000 mL of methanol, 88.3 g of potassium carbonate were added, and the mixture was heated to 67° C. 102.0 g of 4-(chloromethyl)styrene was then added dropwise over the course of 22 minutes to this reaction solution, which was then reacted for 12 hours at 67° C. The resulting reaction solution was cooled, the methanol was removed under reduced pressure, followed by hexane washing and filtration. The residue was dissolved in methanol and re-precipitated by dripping into water, and the precipitate was filtered. This re-precipitation operation was repeated twice, and the residue was dried for 48 hours at 80° C. to obtain 48.7 g of the compound C2 represented by the following formula.

Compound C2

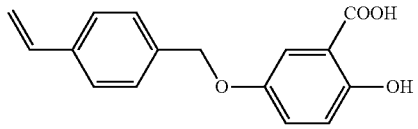

Synthesis Example of Compound C3

(Step 1)

100 g of 2,5-dihydroxybenzoic acid and 1441 g of 80% sulfuric acid were heated to 50° C. and mixed. 144 g of tert-butyl alcohol was added to this dispersion, which was then stirred for 30 minutes at 50° C. The operation of further addition of 144 g of tert-butyl alcohol to the dispersion and stirring for 30 minutes was repeated three times. The reaction solution was cooled to room temperature and poured slowly into 1 kg of ice water, and the precipitate was filtered, water washed, and then washed with hexane. The resulting precipitate was dissolved in 200 mL of methanol, reprecipitated in 3.6 L of water, filtered, and dried at 80° C. to obtain 74.9 g of the salicylic acid intermediate represented by the following formula.

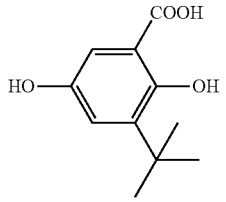

Salicylic Acid Intermediate (Step 2)

A compound C3 shown by the following formula was obtained as in the synthesis example of compound C2 except that 25.0 g of the salicylic acid intermediate represented by the formula above was substituted for the 2,5-dihydroxybenzoic acid.

Compound C3

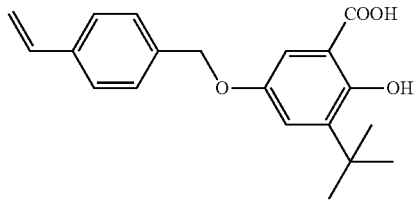

Synthesis Example of Compound C4

A salicylic acid intermediate was obtained by the same methods used to synthesize compound C3 (Step 1), except that 253 g of 2-octanol were substituted for the 144 g of tert-butyl alcohol. A compound C4 represented by the following formula was obtained by the same methods as in the synthesis example of compound C3 (Step 2), but using 32 g of the salicylic acid intermediate obtained here.

Compound C4

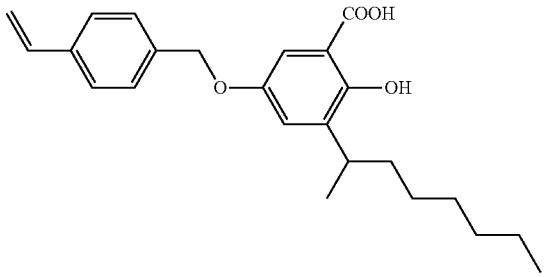

Synthesis Example of Compound C5

53.9 g of 2,3-dihydroxybenzoic acid were dissolved in 280 mL of methanol, 106 g of $K_2CO_3$ was added, and the mixture was stirred for 30 minutes at 65° C. 61.7 g of 4-chloromethylstyrene were then added dropwise for 1 hour. This was reacted for 3 hours under reflux and cooled to room temperature, and the precipitate was filtered out and washed with methanol. The methanol in the filtrate was removed under reduced pressure to obtain a brown semi-solid. This brown semi-solid was washed with ethyl acetate and dispersed in water, and the pH was adjusted to 1 with hydrochloric acid. The ethyl acetate layer was washed with saturated saline and dried with magnesium sulfate, and the solvent was removed under reduced pressure to obtain 124.3 g of a light yellow solid. This light yellow solid was re-crystallized with toluene to obtain 54.5 g of a compound C5 represented by the following formula.

Compound C5

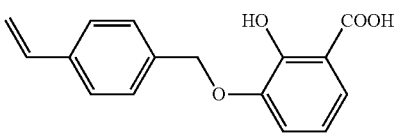

Synthesis Example of Compound C6

A compound C6 represented by the following formula was synthesized by the methods described in Japanese Patent Application Publication No. S63-270060.

Compound C6

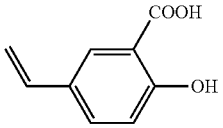

Compound C7

2-acrylamido-2-methylpropanesulfonic acid was used as compound C7.

Compound C8

Vinyl sulfonic acid was used as compound C8.

Synthesis Example of Resin A1

60.0 parts of toluene were loaded into a reaction vessel equipped with a stirrer, a condenser, a thermometer and a nitrogen introduction tube, and refluxed in a flow of nitrogen.

Next, the following raw materials and solvents were mixed to prepare a monomer mixture.

| | |
|---|---|
| Styrene | 100.0 parts |
| Compound C1 | 8.6 parts |
| Stearyl methacrylate | 25.3 parts |
| Toluene | 60.0 parts |

10.0 parts of t-butyl peroxyisopropyl monocarbonate (75% hydrocarbon solvent dilution) as a polymerization initiator were mixed with this monomer mixture, which was then added dropwise to the previous reaction vessel over the course of 30 minutes. This was stirred at 125° C., and cooled to room temperature once the desired molecular weight had been obtained. The resulting polymer-containing composition was added dropwise for 10 minutes with stirring to a mixed solution of 1400 parts of methanol and 10 parts of acetone, to precipitate and crystallize a resin composition. The resulting resin composition was filtered, and rinsed twice with 200 parts of methanol. The resulting resin powder was dried for 10 hours at 60° C. under reduced pressure to obtain a resin A1. The resulting resin A1 had a hydrophobic parameter HPA of 0.75, a weight-average molecular weight (Mw) of 25,000, and an acid value of 15.1 mg KOH/g.

Synthesis Examples of Resins A2 to A26

Resins A2 to A26 were synthesized by the same methods used in the synthesis example of resin A1 except that the types and amounts of the monomers, the polymerization temperature and the amount of initiator were changed appropriately as shown in Table 3. The analysis results for each synthesized resin A are shown in Table 4. In Formula (6), the values for n are n=2 (propyl methacrylate), n=3 (butyl methacrylate), n=17 (stearyl methacrylate) and n=21 (behenyl methacrylate), respectively.

Resin A27

DISPERSBYK (registered trademark)-102 (Byk Additives & Instruments) was used as resin A27.

The resin A27 had an acid value of 101 mg KOH/g, and an HPA of 0.40.

TABLE 3

| | Monomer ratios (mol %) | | | | | | |
|---|---|---|---|---|---|---|---|
| | Compound C | | | Stearyl | Butyl | Propyl | Behenyl |
| Resin A | type | Ratio | Styrene | methacrylate | methacrylate | methacrylate | methacrylate |
| A1 | C1 | 3 | 90 | 7 | — | — | — |
| A2 | C1 | 3 | 87 | 10 | — | — | — |
| A3 | C1 | 4 | 91 | 5 | — | — | — |
| A4 | C1 | 2 | 90 | 8 | — | — | — |
| A5 | C7 | 2 | 91 | 7 | — | — | — |
| A6 | C8 | 2 | 91 | 7 | — | — | — |

TABLE 3-continued

| | Monomer ratios (mol %) | | | | | | |
|---|---|---|---|---|---|---|---|
| | Compound C | | | Stearyl | Butyl | Propyl | Behenyl |
| Resin A | type | Ratio | Styrene | methacrylate | methacrylate | methacrylate | methacrylate |
| A7 | C3 | 3 | 90 | 7 | — | — | — |
| A8 | C2 | 3 | 90 | 7 | — | — | — |
| A9 | C5 | 3 | 90 | 7 | — | — | — |
| A10 | C6 | 3 | 87 | 10 | — | — | — |
| A11 | C4 | 3 | 90 | 7 | — | — | — |
| A12 | C1 | 3 | 87 | — | 10 | — | — |
| A13 | C1 | 3 | 87 | — | — | 10 | — |
| A14 | C1 | 3 | 90 | — | — | — | 7 |
| A15 | C1 | 1 | 92 | 7 | — | — | — |
| A16 | C1 | 0.5 | 93.5 | 6 | — | — | — |
| A17 | C1 | 5 | 85 | 10 | — | — | — |
| A18 | C1 | 6 | 84 | 10 | — | — | — |
| A19 | C1 | 2 | 91 | 7 | — | — | — |
| A20 | C1 | 2 | 91 | 7 | — | — | — |
| A21 | C1 | 2 | 91 | 7 | — | — | — |
| A22 | C1 | 2 | 91 | 7 | — | — | — |
| A23 | C2 | 5 | 88 | 7 | — | — | — |
| A24 | C2 | 3 | 89 | 8 | — | — | — |
| A25 | C1 | 3 | 97 | 0 | — | — | — |
| A26 | C1 | 5 | 95 | 0 | — | — | — |

TABLE 4

| | Molecular weight | | Acid value | |
|---|---|---|---|---|
| Resin A | Mn | Mw | (mg KOH/g) | HPA |
| A1 | 11000 | 25000 | 15.1 | 0.75 |
| A2 | 11500 | 25000 | 15.0 | 0.83 |
| A3 | 12000 | 25000 | 20.2 | 0.64 |
| A4 | 11000 | 26000 | 10.1 | 0.82 |
| A5 | 11000 | 25000 | 9.9 | 0.77 |
| A6 | 11500 | 24500 | 10.0 | 0.67 |
| A7 | 11000 | 25000 | 15.0 | 0.81 |
| A8 | 11000 | 25000 | 15.1 | 0.75 |
| A9 | 9000 | 25000 | 15.0 | 0.75 |
| A10 | 11000 | 25000 | 15.2 | 0.76 |
| A11 | 12000 | 25000 | 14.9 | 0.82 |
| A12 | 11000 | 25000 | 15.1 | 0.63 |
| A13 | 11000 | 25000 | 15.0 | 0.61 |
| A14 | 11000 | 25000 | 15.0 | 0.88 |
| A15 | 12000 | 28000 | 5.0 | 0.84 |
| A16 | 11000 | 28000 | 2.4 | 0.84 |
| A17 | 12000 | 28000 | 24.8 | 0.73 |
| A18 | 13000 | 29000 | 31.0 | 0.65 |
| A19 | 5000 | 12000 | 10.0 | 0.80 |
| A20 | 3000 | 8500 | 10.0 | 0.80 |
| A21 | 27000 | 70000 | 10.3 | 0.80 |
| A22 | 30500 | 80000 | 10.5 | 0.80 |
| A23 | 11000 | 25000 | 25.0 | 0.65 |
| A24 | 8500 | 23500 | 15.2 | 0.78 |
| A25 | 11000 | 25000 | 15.0 | 0.60 |
| A26 | 11000 | 25000 | 25.1 | 0.44 |

Synthesis of Resin B1

100 parts of a mixture of raw material monomers in the molar ratios shown in Table 5-1 were added to a reaction vessel equipped with a stirrer, a thermometer, a nitrogen introduction tube, a dewatering tube and a pressure reduction device, and heated to 130° C. while being stirred. 0.52 parts of di(2-ethylhexanoic acid)tin were then added as an esterification catalyst, and the mixture was warmed to 200° C. and polycondensed until the desired molecular weight was attained to obtain a resin B1. The physical properties of the resulting resin B1 are shown in Table 5-1.

Synthesis of Resins B2, B4

Resins B2 and B4 were synthesized by methods similar to those used for resin B1 above except that the types and amounts of the raw material monomers were changed as shown in Table 5-1. Analysis results for the resulting resins B2 and B4 are shown in Table 5-1.

Manufacturing Example of Resin B3

200 parts of xylene were loaded into a reaction vessel with attached stirrer, condenser, thermometer and nitrogen introduction tube. 100 parts of a mixture of raw material monomers mixed in the molar ratios shown in Table 5-2 were mixed with 13.7 parts of a 75% toluene solution of the polymerization initiator 1,1,3,3-tetramethylbutylperoxy-2-ethylhexanoate, and added dropwise to the reaction vessel with stirring. This was heated to 65° C. and stirred, and once the desired molecular weight was reached the reaction solution was cooled to terminate the reaction. The reaction solution was purified by solid-liquid separation in methanol, and dried at 40° C. under reduced pressure to obtain a resin B3. The molecular weight and acid value were analyzed by the methods described above. The physical properties of the resulting resin B3 are shown in Table 5-2.

Synthesis Examples of Resins B5 to B8

Resins B5 to B8 were synthesized by methods similar to those used for resin B3 except that the types and amounts of the raw material monomers were changed as shown in Table 5-2. Analysis results for the resulting resins B5 to B8 are shown in Table 5-2.

TABLE 5-1

| | Monomer ratios (mol parts) | | | | | | | | | | | |
|---|---|---|---|---|---|---|---|---|---|---|---|---|
| | Acid monomer | | | | Alcohol monomer | | | Molecular weight | | Acid value | TgB | |
| Resin B | TPA | IPA | TMA | CHDA | BPA-PO | EG | isosorbide | Mn | Mw | (mg KOH/g) | (° C.) | HPB |
| B1 | 24 | 23 | 3 | 0 | 50 | 0 | 0 | 3300 | 12000 | 15.0 | 75 | 0.59 |
| B2 | 44 | 0 | 2 | 0 | 30 | 18 | 2.5 | 5200 | 21000 | 2.5 | 70 | 0.47 |
| B4 | 28 | 0 | 2 | 20 | 30 | 20 | 0 | 4100 | 12400 | 7.5 | 70 | 0.47 |

In Table 5-1, terephthalic acid is shown as TPA, isophthalic acid as IPA, trimellitic acid as TMA, cyclohexanedicarboxylic acid as CHDA, bisphenol A propylene oxide 2-mol adduct as BPA-PO, and ethylene glycol as EG.

TABLE 5-2

| | Monomer ratios (mol parts) | | | | | Molecular weight | | Acid value | TgB | |
|---|---|---|---|---|---|---|---|---|---|---|
| Resin B | St | MMA | STMA | MAA | HEMA | Mn | Mw | (mg KOH/g) | (° C.) | HPB |
| B3 | 91.7 | 2.5 | 0 | 3.3 | 2.5 | 10500 | 22000 | 18.0 | 52 | 0.69 |
| B5 | 88 | 0 | 8 | 3 | 10 | 12300 | 24000 | 20.0 | 97 | 0.70 |
| B6 | 84.9 | 0 | 0 | 0.15 | 15 | 11400 | 22500 | 1.0 | 120 | 0.62 |
| B7 | 82 | 0 | 9 | 6 | 3 | 12000 | 23000 | 35.0 | 46 | 0.65 |
| B8 | 10 | 0 | 7 | 3 | 0 | 12000 | 24000 | 18.0 | 94 | 0.76 |

In Table 5-2, St represents styrene, MMA is methyl methacrylate, STMA is stearyl methacrylate, MAA is methacrylic acid, and HEMA is 2-hydroxyethyl methacrylate.

(Manufacture of Styrene Acrylic Resin 1)

200 parts of xylene were loaded into a reaction vessel with attached stirrer, condenser, thermometer and nitrogen introduction tube. 75 parts of styrene, 25 parts of n-butyl acrylate and 10.0 parts of a 75% toluene solution of the polymerization initiator 1,1,3,3-tetramethylbutylperoxy-2-ethylhexanoate were mixed, and added dropwise with stirring to the previous reaction vessel. This was heated to 65° C. and stirred, and once the desired molecular weight was reached the reaction solution was cooled to terminate the reaction. The reaction solution was purified by solid-liquid separation in methanol, and dried at 40° C. under reduced pressure to obtain a styrene acrylic resin 1. The resulting styrene acrylic resin 1 had an Mn of 14,000 and an Mw of 35,000.

(Manufacture of Polyester Resin 1)

100 parts of bisphenol A-PO 2-mol adduct, 21.7 parts of terephthalic acid and 23.5 parts of sebacic acid were added to a reaction vessel equipped with a stirrer, a thermometer, a nitrogen introduction tube, a dewatering tube and a pressure reduction device, and heated to 130° C. while being stirred. 0.52 parts of di(2-ethylhexanoic acid)tin were then added as an esterification catalyst, and the mixture was warmed to 200° C. and polycondensed until the desired molecular weight was attained to obtain a polyester resin 1. The resulting polyester resin 1 had an Mn of 8000 and an Mw of 27,000.

Toner 1 Manufacturing Example

| | |
|---|---|
| Styrene | 216.0 parts |
| Basic-treated pigment 1 | 36.0 parts |
| Resin A1 | 3.6 parts |

These materials were introduced into an attritor (Mitsui Miike Chemical Engineering Machinery Co., Ltd.), and stirred for 180 minutes at 250 rpm, 25° C. with zirconia beads with a radius of 2.5 mm (180 parts) to prepare a master batch dispersion (MB) 1.

| | |
|---|---|
| Master batch dispersion 1 | 191.7 parts |
| Styrene monomer | 116.1 parts |
| n-butyl acrylate monomer | 92.7 parts |
| Hydrocarbon wax (HNP-9, Nippon Seiro Co., Ltd.) | 31.5 parts |
| Resin B1 | 18.0 parts |

These materials were mixed and heated to 65° C., then uniformly dissolved and dispersed for 60 minutes at 3500 rpm with a T.K. Homomixer (Tokushu Kika Kogyo Co., Ltd.) to obtain a toner composition solution. Meanwhile, 480.0 parts of a 0.1 mol/L $Na_3PO_4$ aqueous solution was added to 1000.0 parts of ion-exchange water in a 2 liter four-necked flask equipped with a T.K. Homomixer, and heated to 60° C. with the T.K. Homomixer adjusted to 10,000 rpm. 71.9 parts of a 1.0 mol/L aqueous $CaCl_2$ solution and 3.9 parts of 10% hydrochloric acid were then gradually added to obtain an aqueous medium containing a calcium phosphate compound.

Next, 13.7 parts of a 75% toluene solution of the polymerization initiator 1,1,3,3-tetramethylbutylperoxy-2-ethylhexanoate were dissolved in the toner composition solution, thoroughly mixed, and then added to the previous aqueous medium. This was stirred for 10 minutes at 10,000 rpm in the T.K. Homomixer at 65° C. in a $N_2$ atmosphere to granulate a polymerizable monomer composition. This was then warmed to 75° C. while being stirred with a paddle stirring blade, and polymerized for 5 hours. After being warmed to 85° C. at a rate of 1° C./minute, the composition was reacted for 1 hour, and the polymerization reaction was terminated. Residual monomers were then removed from the toner particle under reduced pressure, and the aqueous medium was cooled to obtain a toner particle dispersion.

Hydrochloric acid was added to reduce the pH of the toner particle dispersion to 1.4, and the dispersion was stirred for 1 hour to dissolve the calcium phosphate salt. Solid-liquid separation was then performed under 0.4 Mpa of pressure in a pressure filter unit to obtain a toner cake. Ion-exchange water was then added until the pressure filter unit was full, and the toner was washed under 0.4 Mpa of pressure. This washing operation was repeated three times, and the product was dried to obtain a toner particle 1. The resulting toner particle had a weight-average particle diameter (D4) of 5.7 μm.

1.5 mass parts of a hydrophobic silica fine particle that had been surface treated with hexamethyldisilazane (number-average particle diameter of primary particles: 10 nm) were added to 100 parts of the toner particle 1, and mixed for 300 seconds in a Mitsui Henschel mixer (Mitsui Miike Chemical Engineering Machinery Co., Ltd.) to obtain a toner 1.

Manufacturing Examples of Toners 2 to 40

Toners 2 to 40 were obtained as in the manufacturing example of toner 1 except that the toner particle materials were changed as shown in Tables 6-1 and 6-2. The resulting toners 2 to 40 are shown in Tables 6-1 and 6-2.

Manufacturing Examples of Comparative Toners 1 to 5

Comparative toners 1 to 5 were obtained as in the manufacturing example of toner 1 except that the toner particle materials were changed as shown in Tables 6-1 and 6-2. The resulting comparative toners 1 to 5 are shown in Tables 6-1 and 6-2

TABLE 6-1

| | MB | | | | |
|---|---|---|---|---|---|
| Toner No. | Styrene (parts) | Basic-treated pigment No. | (parts) | Resin A | (parts) |
| 1 | 216.0 | 1 | 36.0 | A1 | 3.6 |
| 2 | 216.0 | 1 | 36.0 | A1 | 3.6 |

TABLE 6-1-continued

| | MB | | | | |
|---|---|---|---|---|---|
| Toner No. | Styrene (parts) | Basic-treated pigment No. | (parts) | Resin A | (parts) |
| 3 | 216.0 | 1 | 36.0 | A2 | 3.6 |
| 4 | 216.0 | 1 | 36.0 | A3 | 3.6 |
| 5 | 216.0 | 1 | 36.0 | A4 | 3.6 |
| 6 | 216.0 | 2 | 36.0 | A1 | 3.6 |
| 7 | 216.0 | 3 | 36.0 | A1 | 3.6 |
| 8 | 216.0 | 4 | 36.0 | A1 | 3.6 |
| 9 | 216.0 | 5 | 42.0 | A1 | 4.2 |
| 10 | 216.0 | 6 | 48.0 | A1 | 4.8 |
| 11 | 216.0 | 7 | 36.0 | A1 | 3.6 |
| 12 | 216.0 | 8 | 36.0 | A1 | 3.6 |
| 13 | 216.0 | 9 | 36.0 | A1 | 3.6 |
| 14 | 216.0 | 10 | 36.0 | A1 | 3.6 |
| 15 | 216.0 | 2 | 36.0 | A5 | 3.6 |
| 16 | 216.0 | 2 | 36.0 | A6 | 3.6 |
| 17 | 216.0 | 2 | 36.0 | A7 | 3.6 |
| 18 | 216.0 | 2 | 36.0 | A8 | 3.6 |
| 19 | 216.0 | 2 | 36.0 | A9 | 3.6 |
| 20 | 216.0 | 2 | 36.0 | A10 | 3.6 |
| 21 | 216.0 | 2 | 36.0 | A11 | 3.6 |
| 22 | 216.0 | 2 | 36.0 | A12 | 3.6 |
| 23 | 216.0 | 2 | 36.0 | A13 | 3.6 |
| 24 | 216.0 | 2 | 36.0 | A14 | 3.6 |
| 25 | 216.0 | 1 | 36.0 | A2 | 0.7 |
| 26 | 216.0 | 1 | 36.0 | A2 | 0.2 |
| 27 | 216.0 | 1 | 36.0 | A2 | 10.8 |
| 28 | 216.0 | 1 | 36.0 | A2 | 14.4 |
| 29 | 216.0 | 2 | 36.0 | A15 | 3.6 |
| 30 | 216.0 | 2 | 36.0 | A16 | 3.6 |
| 31 | 216.0 | 2 | 36.0 | A17 | 3.6 |
| 32 | 216.0 | 2 | 36.0 | A18 | 3.6 |
| 33 | 216.0 | 1 | 36.0 | A19 | 3.6 |
| 34 | 216.0 | 1 | 36.0 | A20 | 3.6 |
| 35 | 216.0 | 1 | 36.0 | A21 | 3.6 |
| 36 | 216.0 | 1 | 36.0 | A22 | 3.6 |
| 37 | 216.0 | 1 | 36.0 | A23 | 3.6 |
| 38 | 216.0 | 1 | 36.0 | A8 | 3.6 |
| 39 | 216.0 | 1 | 36.0 | A24 | 0.9 |
| 40 | 216.0 | 1 | 36.0 | A24 | 0.4 |
| Comparative 1 | 216.0 | 1 | 36.0 | A25 | 3.6 |
| Comparative 2 | 216.0 | 1 | 36.0 | A25 | 3.6 |
| Comparative 3 | 216.0 | 1 | 36.0 | A26 | 3.6 |
| Comparative 4 | 216.0 | 1 | 36.0 | A25 | 3.6 |
| Comparative 5 | 216.0 | 1 | 36.0 | A25 | 3.6 |

TABLE 6-2

| | Toner particle composition | | | | | | | | |
|---|---|---|---|---|---|---|---|---|---|
| Toner No. | MB (parts) | Styrene (parts) | Butyl acrylate (parts) | Resin B | (parts) | WAX HNP-9 (parts) | Initiator (parts) | Parameter HPA-HPB | Particle size D4 (μm) |
| 1 | 191.7 | 116.1 | 92.7 | B1 | 18.0 | 31.5 | 13.9 | 0.16 | 5.7 |
| 2 | 191.7 | 116.1 | 92.7 | B2 | 18.0 | 31.5 | 13.9 | 0.28 | 5.9 |
| 3 | 191.7 | 116.1 | 92.7 | B3 | 18.0 | 31.5 | 13.9 | 0.14 | 5.6 |
| 4 | 191.7 | 116.1 | 92.7 | B4 | 18.0 | 31.5 | 13.9 | 0.17 | 5.7 |
| 5 | 191.7 | 116.1 | 92.7 | B5 | 18.0 | 31.5 | 13.9 | 0.12 | 6.3 |
| 6 | 191.7 | 116.1 | 92.7 | B1 | 18.0 | 31.5 | 13.9 | 0.16 | 6.1 |
| 7 | 191.7 | 116.1 | 92.7 | B1 | 18.0 | 31.5 | 13.9 | 0.16 | 6.3 |
| 8 | 191.7 | 116.1 | 92.7 | B1 | 18.0 | 31.5 | 13.9 | 0.16 | 6.2 |
| 9 | 196.7 | 112.4 | 91.5 | B1 | 18.0 | 31.5 | 13.9 | 0.16 | 5.9 |
| 10 | 201.6 | 108.7 | 90.2 | B1 | 18.0 | 31.5 | 13.9 | 0.16 | 5.9 |
| 11 | 191.7 | 116.1 | 92.7 | B2 | 18.0 | 31.5 | 13.9 | 0.28 | 5.6 |
| 12 | 191.7 | 116.1 | 92.7 | B2 | 18.0 | 31.5 | 13.9 | 0.28 | 6.1 |
| 13 | 191.7 | 116.1 | 92.7 | B2 | 18.0 | 31.5 | 13.9 | 0.28 | 6.1 |
| 14 | 191.7 | 116.1 | 92.7 | B2 | 18.0 | 31.5 | 13.9 | 0.28 | 5.9 |
| 15 | 191.7 | 116.1 | 92.7 | B1 | 18.0 | 31.5 | 13.9 | 0.18 | 5.8 |
| 16 | 191.7 | 116.1 | 92.7 | B1 | 18.0 | 31.5 | 13.9 | 0.08 | 6.3 |
| 17 | 191.7 | 116.1 | 92.7 | B1 | 18.0 | 31.5 | 13.9 | 0.22 | 6.1 |
| 18 | 191.7 | 116.1 | 92.7 | B1 | 18.0 | 31.5 | 13.9 | 0.16 | 6.0 |
| 19 | 191.7 | 116.1 | 92.7 | B1 | 18.0 | 31.5 | 13.9 | 0.16 | 6.1 |

TABLE 6-2-continued

| Toner No. | Toner particle composition MB (parts) | Styrene (parts) | Butyl acrylate (parts) | Resin B | (parts) | WAX HNP-9 (parts) | Initiator (parts) | Parameter HPA-HPB | Particle size D4 (μm) |
|---|---|---|---|---|---|---|---|---|---|
| 20 | 191.7 | 116.1 | 92.7 | B1 | 18.0 | 31.5 | 13.9 | 0.17 | 6.3 |
| 21 | 191.7 | 116.1 | 92.7 | B1 | 18.0 | 31.5 | 13.9 | 0.23 | 6.2 |
| 22 | 191.7 | 116.1 | 92.7 | B4 | 18.0 | 31.5 | 13.9 | 0.16 | 6.1 |
| 23 | 191.7 | 116.1 | 92.7 | B4 | 18.0 | 31.5 | 13.9 | 0.14 | 6.1 |
| 24 | 191.7 | 116.1 | 92.7 | B4 | 18.0 | 31.5 | 13.9 | 0.41 | 5.9 |
| 25 | 189.5 | 117.7 | 93.2 | B2 | 18.0 | 31.5 | 14.1 | 0.36 | 6.2 |
| 26 | 189.1 | 118.0 | 93.3 | B2 | 9.0 | 31.5 | 14.2 | 0.36 | 6.2 |
| 27 | 197.1 | 112.1 | 91.4 | B2 | 18.0 | 31.5 | 13.4 | 0.36 | 6.3 |
| 28 | 199.8 | 110.0 | 90.7 | B2 | 18.0 | 31.5 | 13.2 | 0.36 | 6.0 |
| 29 | 191.7 | 116.1 | 92.7 | B2 | 18.0 | 31.5 | 13.9 | 0.37 | 6.0 |
| 30 | 191.7 | 116.1 | 92.7 | B2 | 18.0 | 31.5 | 13.9 | 0.37 | 6.3 |
| 31 | 191.7 | 116.1 | 92.7 | B2 | 18.0 | 31.5 | 13.9 | 0.26 | 5.6 |
| 32 | 191.7 | 116.1 | 92.7 | B2 | 18.0 | 31.5 | 13.9 | 0.18 | 6.3 |
| 33 | 191.7 | 116.1 | 92.7 | B1 | 18.0 | 31.5 | 13.9 | 0.21 | 6.0 |
| 34 | 191.7 | 116.1 | 92.7 | B1 | 18.0 | 31.5 | 13.9 | 0.21 | 6.1 |
| 35 | 191.7 | 116.1 | 92.7 | B1 | 18.0 | 31.5 | 13.9 | 0.21 | 6.0 |
| 36 | 191.7 | 116.1 | 92.7 | B1 | 18.0 | 31.5 | 13.9 | 0.21 | 6.2 |
| 37 | 191.7 | 116.1 | 92.7 | B1 | 18.0 | 31.5 | 13.9 | 0.06 | 5.9 |
| 38 | 191.7 | 116.1 | 92.7 | B5 | 18.0 | 31.5 | 13.9 | 0.04 | 5.7 |
| 39 | 189.7 | 105.8 | 89.3 | B1 | 33.8 | 31.5 | 12.7 | 0.19 | 5.6 |
| 40 | 189.3 | 97.7 | 86.6 | B1 | 45.0 | 31.5 | 11.7 | 0.19 | 6.1 |
| Comparative 1 | 191.7 | 116.1 | 92.7 | B6 | 18.0 | 31.5 | 13.9 | 0.02 | 6.2 |
| Comparative 2 | 191.7 | 116.1 | 92.7 | B7 | 18.0 | 31.5 | 13.9 | 0.05 | 6.3 |
| Comparative 3 | 191.7 | 116.1 | 92.7 | B1 | 18.0 | 31.5 | 13.9 | 0.15 | 5.9 |
| Comparative 4 | 191.7 | 116.1 | 92.7 | B8 | 18.0 | 31.5 | 13.9 | 0.16 | 6.0 |
| Comparative 5 | 191.7 | 116.1 | 92.7 | — | — | 31.5 | 13.9 | — | 6.0 |

Manufacturing Example of Toner 41

| | |
|---|---|
| Methylethylketone | 144.0 parts |
| Basic-treated pigment 1 | 36.0 parts |
| Resin A1 | 3.6 parts |

These materials were introduced into an attritor, and stirred for 180 minutes at 250 rpm, 25° C. with zirconia beads with a radius of 2.5 mm (180 parts) to prepare a master batch dispersion 41.

| | |
|---|---|
| Master batch dispersion 41 | 96.4 parts |
| Methylethylketone | 59.4 parts |
| Styrene acrylic resin 1 | 259.6 parts |
| Hydrocarbon wax (HNP-9, Nippon Seiro Co., Ltd.) | 18.9 parts |
| Resin B1 | 15.8 parts |

These materials were mixed and heated to 75° C., and uniformly dissolved and dispersed for 60 minutes at 5000 rpm with a T.K. Homomixer to obtain a toner composition solution.

Meanwhile, 480.0 parts of a 0.1 mol/L $Na_3PO_4$ aqueous solution were added to 1000.0 parts of ion-exchange water in a 2 liter four-necked flask equipped with a T.K. Homomixer, and heated to 60° C. with the T.K. Homomixer adjusted to 10,000 rpm. 71.9 parts of a 1.0 mol/L aqueous $CaCl_2$ solution and 3.9 parts of 10% hydrochloric acid were then gradually added to obtain an aqueous medium containing a calcium phosphate compound.

Next, the toner composition solution was added to this aqueous medium. This was stirred for 30 minutes at 13,000 rpm in a T.K. Homomixer at 75° C. to granulate the toner composition solution. This was then warmed to 85° C. while being stirred with a paddle stirring blade, and distilled for 5 hours at normal pressure. Residual solvent was further distilled off under reduced pressure, and the aqueous medium was cooled to obtain a toner particle dispersion.

Hydrochloric acid was added to reduce the pH of the toner particle dispersion to 1.4, and the dispersion was stirred for 1 hour to dissolve the calcium phosphate compound. Solid-liquid separation was then performed under 0.4 Mpa pressure in a pressure filter unit to obtain a toner cake. Ion-exchange water was then added until the pressure filter unit was full, and the toner was washed under 0.4 Mpa pressure. This washing operation was repeated three times, and the product was dried to obtain a toner particle 41. The weight-average particle diameter (D4) of the resulting toner particle was 6.2 μm.

As in the case of the toner particle 1, hydrophobic silica fine particles that had been surface treated with hexamethyldisilazane were added to the resulting toner particle 41, to obtain a toner 41. The resulting toner 41 is shown in Tables 7-1 and 7-2.

TABLE 7-1

| | MB MEK (parts) | Pigment | (parts) | Resin A | (parts) |
|---|---|---|---|---|---|
| Toner 41 | 144.0 | Basic-treated pigment 1 | 36.0 | A1 | 3.6 |
| Comparative toner 6 | 144.0 | Basic-treated pigment 1 | 36.0 | — | — |
| Comparative toner 7 | 144.0 | Pigment blue 15:3 | 36.0 | — | — |
| Comparative toner 8 | 144.0 | Basic-treated pigment 1 | 36.0 | A27 | 3.6 |

TABLE 7-2

| | Toner particle composition | | | | | | | | | Particle |
|---|---|---|---|---|---|---|---|---|---|---|
| | MB (parts) | MEK (parts) | Resin B | (parts) | Other resin | (parts) | WAX | (parts) | HPA-HPB | diameter D4 (μm) |
| Toner 41 | 96.4 | 59.4 | B1 | 15.8 | Styrene acrylic resin 1 | 259.6 | HNP-9 | 18.9 | 0.16 | 6.2 |
| Comparative toner 6 | 94.5 | 59.4 | B1 | 15.8 | Styrene acrylic resin 1 | 261.5 | HNP-9 | 18.9 | — | 6.7 |
| Comparative toner 7 | 94.5 | 59.4 | B1 | 15.8 | Styrene acrylic resin 1 | 261.5 | HNP-9 | 18.9 | — | 6.8 |
| Comparative toner 8 | 96.4 | 59.4 | B1 | 15.8 | Styrene acrylic resin 1 | 259.6 | HNP-9 | 18.9 | −0.19 | 6.3 |

Manufacturing Example of Toner 42

Toner Manufacturing Example

| | |
|---|---|
| Methylethylketone | 120.0 parts |
| Basic-treated pigment 1 | 30.0 parts |
| Resin A1 | 3.0 parts |

These materials were introduced into an attritor, and stirred for 180 minutes at 250 rpm, 25° C. with zirconia beads with a radius of 2.5 mm (180 parts) to prepare a master batch dispersion 42.

The polyester resin 1 (124.1 parts) was placed in a twin-screw kneader (PCM-30, Ikegai Corp) set to 120° C., and the master batch dispersion 42 (143.7 parts) was added in three additions, and kneaded to remove the solvent.

| | |
|---|---|
| Polyester resin 1 | 289.6 parts |
| Resin B1 | 18.8 parts |
| Hydrocarbon wax (HNP-9, Nippon Seiro Co., Ltd.) | 24.8 parts |

The materials listed above were then added and kneaded.

The resulting kneaded material was cooled, and coarsely crushed to 1 mm or less in a hammer mill to produce a coarsely crushed material. The resulting coarsely crushed material was then pulverized with a mechanical pulverizer (T-250, Turbo Kogyo Co., Ltd.). It was then classified with a rotary classifier (200 TSP, Hosokawa Micron Corporation) to obtain a toner particle 42. For the operating conditions of the rotary classifier (200 TSP, Hosokawa Micron Corporation), the classification rotor speed was 50.0 $s^{-1}$. The resulting toner particle 42 had a weight-average particle diameter (D4) of 6.3 μm.

As in the case of the toner particle 1, hydrophobic silica fine particles that had been surface treated with hexamethyldisilazane were added to the resulting toner particle 42, to obtain a toner 42. In the toner 42, HPA−HPB is 0.16, and the amount of the resin A per 100 parts of the resin B is 15.0 parts.

Manufacturing Example of Toner Particle 43

Manufacturing Example of Colorant Particle Dispersion 1

| | |
|---|---|
| Methylethylketone | 240.0 parts |
| Basic-treated pigment 1 | 60.0 parts |
| Resin A1 | 6.0 parts |

These materials were introduced into an attritor, and stirred for 180 minutes at 250 rpm, 25° C. with zirconia beads with a radius of 2.5 mm (180 parts) to prepare a master batch dispersion 43.

5 parts of an anionic surfactant (Neogen R, DKS Co. Ltd.) were mixed and dissolved in 250.0 parts of ion-exchange water. The master batch dispersion 43 was then added dropwise as the mixture was emulsified and dispersed with a homogenizer (Ultra-Turrax, IKA Japan K.K.), and dispersion was continued for 10 minutes after all of the dispersion had been added. The solvent was distilled off from the resulting dispersion at room temperature under reduced pressure until the solid content was 25%, and the mixture was dispersed for 30 minutes with an ultrasound bath to obtain a colorant particle dispersion 1 with a solid content of 25% and a center diameter of 200 nm.

Manufacturing Example of Resin Particle Dispersion 1

| | |
|---|---|
| Methylethylketone | 200.0 parts |
| Polyester resin 1 | 280.2 parts |

These materials were placed in reactor equipped with a stirrer, and dissolved and mixed for 60 minutes at 70° C., after which an aqueous neutralizing solution consisting of 5.0 parts of sodium dodecylbenzenesulfonate and 3.0 parts of 1 N NaOH aqueous solution dissolved in 1200 parts of ion-exchange water heated to 95° C. was added to the flask, and the mixture was emulsified for 5 minutes with a homogenizer (Ultra-Turrax). The solvent was distilled off from this dispersion at 60° C. under reduced pressure until the solid content was 20%, after which the mixture was dispersed for 30 minutes with an ultrasound bath, and the flask was cooled with room-temperature (25° C.) water, resulting in a resin particle dispersion 1 with a solid content of 20 mass % and a median diameter of 250 nm of the resin particle.

Manufacturing Example of Release Agent Particle Dispersion 1

| | |
|---|---|
| Anionic surfactant (Neogen R, DKS Co. Ltd.) | 0.8 parts |
| Ion-exchange water | 350.0 parts |
| Hydrocarbon wax (HNP, Nippon Seiro) | 40.0 parts |

These components were mixed, heated to 120° C., and dispersed with a pressure discharge type Gaulin homogenizer to obtain a 20 mass % release agent particle dispersion 1 with a volume-average particle diameter of 170 nm.

Manufacturing Example of Coating Resin Particle Dispersion 1

| | |
|---|---|
| Methylethylketone | 100.0 parts |
| Resin B1 | 70.6 parts |

These materials were placed in a reactor equipped with a stirrer, and dissolved and mixed for 60 minutes at 70° C., after which an aqueous neutralizing solution consisting of 1.4 parts of sodium dodecylbenzenesulfonate and 3.0 parts of IN NaOH aqueous solution dissolved in 350 parts of ion-exchange water heated to 95° C. was added to the flask, and the mixture was emulsified for 5 minutes with a homogenizer (Ultra-Turrax). The solvent was distilled off from this dispersion at 60° C. under reduced pressure until the solid content was 20%, after which the mixture was dispersed for 30 minutes with an ultrasound bath, and the flask was cooled with room-temperature (25° C.) water, resulting in a coating resin particle dispersion 1 with a solid content of 20 mass % and a median diameter of 240 nm of the resin particles.

Preparation of Toner Particle 43

| | |
|---|---|
| Resin particle dispersion 1 | 1660.0 parts |
| Colorant particle dispersion 1 | 105.6 parts |
| Anionic surfactant (Dowfax2A1 20% aqueous solution) | 25.0 parts |
| Release agent particle dispersion 1 | 112.9 parts |

Out of these raw materials, the resin particle dispersion 1, the anionic surfactant and 250 parts of ion-exchange water were added first to a polymerization kettle equipped with a pH meter, a stirrer and a thermometer, and stirred for 15 minutes at 130 rpm as the surfactant was blended with the resin particle dispersion 1. The colorant particle dispersion 1 and release agent dispersion 1 were then added and mixed, and a 0.3 mol/L aqueous nitric acid solution was added to this raw material mixture to bring the pH to 4.8. Shearing force was then applied at 3000 rpm with an Ultra-Turrax as 20.0 parts of a 10% aqueous nitric acid solution of aluminum sulfate were added dropwise as a flocculant. Because the viscosity of the raw material mixture increases as the flocculant is added, the drop speed was reduced once the viscosity started to rise so that the flocculant would not become localized in one part of the mixture. Once all of the flocculant had been added, the mixture was stirred for a further 5 minutes with the rotational speed increased to 5000 rpm, to thoroughly mix the flocculant with the raw material mixture.

Next, the raw material mixture was stirred at 500 rpm while being heated to 25° C. with a mantle heater. Once formation of primary particles had been confirmed, the temperature was raised to 43° C. at 0.1° C./minute to cause growth of aggregated particles. The growth of the aggregated particles was confirmed as needed, and the aggregation temperature and rotational rate of stirring were changed depending on the rate of aggregation.

Once the aggregated particles had grown to 5.2 μm in the aggregation step, the coating resin particle dispersion 1 was added, and maintained with stirring for 20 minutes. A 1 mol/L sodium hydroxide aqueous solution was then added to stop the growth of the coated aggregated particles, and the pH of the raw material mixture was controlled at 7.6. The temperature of the mixture was then raised to 85° C. at a rate of 1° C./minute with the pH adjusted to 7.6 to fuse the aggregated particles. Once 85° C. was reached, the pH was adjusted to 7.6 or less to encourage fusion, and fusion of the aggregated particles was confirmed under an optical microscope, after which ice water was poured in to quickly cool the mixture at 10° C./minute and stop particle growth.

This was then sieved once with a 15 μm mesh to wash the resulting particle. Ion-exchange water (30° C.) in about 10 times the amount of the solid component was added and stirred for 20 minutes, and the mixture was immediately filtered. The solids remaining on the filter paper were dispersed in the slurry, washed four times with 30° C. ion-exchange water, and dried to obtain a toner particle 43. The weight-average particle diameter (D4) of the resulting toner particle 43 was 5.9 μm.

As in the case of the toner particle 1, hydrophobic silica fine particles that had been surface treated with hexamethyldisilazane were added to the resulting toner particle 43 to obtain a toner 43. The weight-average particle diameter (D4) of the resulting toner was 5.9 μm.

In toner 43, HPA−HPB is 0.16, and the amount of resin A per 100 parts of resin B is 15.0 parts.

Manufacturing Examples of Comparative Toners 6 to 8

Comparative toners 6 to 8 were obtained as in the manufacturing example of toner 41 except that the materials of the toner particle were changed as shown in Tables 7-1 and 7-2. The resulting comparative toners 6 to 8 are shown in Tables 7-1 and 7-2.

Examples 1 to 43, Comparative Examples 1 to 8

The tinting strength, durability and heat resistance of the toners 1 to 43 and comparative toners 1 to 8 were evaluated as follows.

(Tinting Strength Evaluation)

The original toner was removed from a cartridge for a Satera LBP7700C commercial color laser printer (Canon Inc.), the interior was cleaned by air blowing, and the cartridge was filled with a test toner (150 g).

The fixing mechanism was also removed from the color laser printer, which was modified to allow it to output unfixed images, and so that the image density could be adjusted with the controller. It was also modified so that it operated even when a single color cartridge was installed. The removed fixing mechanism was modified so that it could operate independently, and to allow the process speed and temperature to be controlled, to obtain an external fixing mechanism.

The cartridge was mounted in the printer, and a 30 mm white area was created on the upper part of a transfer material above a band image 150 mm in width and 30 mm in height. The controller was set so that the toner laid-on level of the band image was 0.35 mg/cm$^2$. A4 size GF-C081 (Canon Inc., 81.4 g/m$^2$) was used as the transfer material.

10 copies of this band image were output, and fixed at 150° C. at a process speed of 230 mm/second with the external fixing mechanism of the LBP7700C color laser printer.

The image density of the resulting fixed images was measured to evaluate tinting strength.

The image density was measured using an "RD918 Macbeth reflection densitometer" (GretagMacbeth GmbH). Relative density was measured relative to the white background part of the printout image, which had a manuscript density of 0.00, at three points on the left, center and right of each fixed image, and the calculated average of 10 fixed images was evaluated. The evaluation standard was as follows. A score of C or greater means a level at which the effect of the present invention is obtained. The evaluation results are shown in Table 8.

A: Image density at least 1.40

B: Image density at least 1.35 and less than 1.40

C: Image density at least 1.30 and less than 1.35

D: Image density at least 1.25 and less than 1.30

E: Image density less than 1.25

(Durability Evaluation)

The evaluation was performed with a commercial color laser printer (HP Color LaserJet 3525dn, HP Inc.) modified so that it could operate even when only a single color process cartridge was installed. The toner contained in a cyan cartridge installed in this color laser printer was removed, and the interior was cleaned by air blowing, after which the cartridge was filled with 200 g of a test toner. Using Canon Office Planner (64 g/m$^2$) as the image-receiving paper, 20,000 copies of a chart with a print percentage of 1% were output continuously at normal temperature, normal humidity (23° C., 60% RH). After this, a halftone image was output, and the halftone image was observed for vertical streaks in the paper output direction. Durability was evaluated according to the following standard, with a score of C or greater indicating a level at which the effect of the present invention is obtained. The evaluation results are shown in Table 8.

A: No streaks or one streak on the image

B: 2 or 3 streaks on the image

C: 4 streaks on the image

D: 5 streaks on the image

E: At least 6 streaks on the image (Heat-Resistant Storability (Blocking))

5 g samples of each toner were taken in 50 mL resin cups, and left in either a 50° C./10% RH environment or a 55° C./10% RH environment for 72 hours. The presence or absence of toner clumps in the resulting toner was evaluated. A score of C or greater indicated a level at which the effect of the present invention is obtained. The evaluation results are shown in Table 8.

(Evaluation Standard)

A: No clumps

B: Minor clumps that break up when pushed lightly with the fingers

C: Clumps that break up when pushed lightly with the fingers

D: Complete clumping, clumps do not break up when pushed strongly with the fingers

TABLE 8

| | | Evaluation items | | | | | |
|---|---|---|---|---|---|---|---|
| | | Tinting strength | | Durability | | Heat-resistant storability | |
| Example | Toner No. | Rank | Value | Rank | Number of vertical streaks | 50° C. Rank | 55° C. Rank |
| Example 1 | 1 | A | 1.47 | A | 0 | A | A |
| Example 2 | 2 | A | 1.45 | B | 3 | A | B |
| Example 3 | 3 | A | 1.45 | A | 1 | B | C |
| Example 4 | 4 | A | 1.4 | B | 3 | B | B |
| Example 5 | 5 | A | 1.46 | B | 3 | B | B |
| Example 6 | 6 | A | 1.47 | A | 0 | A | A |
| Example 7 | 7 | A | 1.42 | A | 0 | A | A |
| Example 8 | 8 | A | 1.52 | B | 2 | B | C |
| Example 9 | 9 | A | 1.45 | A | 1 | A | B |
| Example 10 | 10 | B | 1.36 | A | 1 | A | B |
| Example 11 | 11 | A | 1.41 | A | 0 | A | A |
| Example 12 | 12 | C | 1.34 | A | 0 | A | A |
| Example 13 | 13 | A | 1.45 | B | 2 | A | B |
| Example 14 | 14 | A | 1.42 | B | 3 | B | B |
| Example 15 | 15 | C | 1.34 | C | 4 | B | C |
| Example 16 | 16 | C | 1.3 | C | 4 | B | C |
| Example 17 | 17 | A | 1.43 | A | 1 | A | B |
| Example 18 | 18 | A | 1.45 | A | 1 | A | A |
| Example 19 | 19 | A | 1.4 | B | 2 | A | B |
| Example 20 | 20 | B | 1.35 | B | 3 | B | B |
| Example 21 | 21 | B | 1.37 | B | 2 | A | B |
| Example 22 | 22 | B | 1.38 | C | 4 | B | B |
| Example 23 | 23 | B | 1.35 | B | 3 | B | B |
| Example 24 | 24 | A | 1.45 | A | 0 | A | A |
| Example 25 | 25 | A | 1.45 | B | 2 | A | B |
| Example 26 | 26 | B | 1.38 | C | 4 | C | C |
| Example 27 | 27 | A | 1.44 | A | 0 | A | A |
| Example 28 | 28 | B | 1.39 | A | 0 | A | A |
| Example 29 | 29 | A | 1.46 | A | 1 | A | B |
| Example 30 | 30 | A | 1.43 | B | 2 | B | B |
| Example 31 | 31 | A | 1.42 | A | 0 | A | A |
| Example 32 | 32 | B | 1.39 | A | 0 | A | A |
| Example 33 | 33 | A | 1.45 | A | 0 | A | A |
| Example 34 | 34 | A | 1.41 | A | 0 | A | A |
| Example 35 | 35 | A | 1.45 | A | 0 | A | A |
| Example 36 | 36 | A | 1.4 | A | 0 | A | A |

TABLE 8-continued

| | | Evaluation items | | | | | |
|---|---|---|---|---|---|---|---|
| | | Tinting strength | | Durability | | Heat-resistant storability | |
| Example | Toner No. | Rank | Value | Rank | Number of vertical streaks | 50° C. Rank | 55° C. Rank |
| Example 37 | 37 | A | 1.43 | A | 1 | B | B |
| Example 38 | 38 | B | 1.38 | B | 2 | B | B |
| Example 39 | 39 | A | 1.46 | B | 2 | A | B |
| Example 40 | 40 | B | 1.38 | B | 3 | B | B |
| Example 41 | 41 | A | 1.46 | A | 1 | A | A |
| Example 42 | 42 | A | 1.46 | C | 4 | B | C |
| Example 43 | 43 | A | 1.46 | C | 4 | B | B |
| Comparative Example 1 | Comparative 1 | C | 1.32 | D | 5 | C | C |
| Comparative Example 2 | Comparative 2 | B | 1.36 | C | 4 | D | D |
| Comparative Example 3 | Comparative 3 | D | 1.28 | D | 5 | C | D |
| Comparative Example 4 | Comparative 4 | C | 1.31 | D | 5 | C | D |
| Comparative Example 5 | Comparative 5 | A | 1.5 | E | 6 | D | D |
| Comparative Example 6 | Comparative 6 | C | 1.32 | D | 5 | C | D |
| Comparative Example 7 | Comparative 7 | D | 1.25 | A | 1 | A | A |
| Comparative Example 8 | Comparative 8 | E | 1.16 | D | 5 | C | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-055236, filed Mar. 18, 2016, which is hereby incorporated by reference herein in its entirety.

What is claimed is:

1. A toner comprising a toner particle, the toner particle comprising:

a binder resin;

a pigment having a structure derived from a basic compound;

a resin A having an acidic functional group, the content of resin A being 1.0 to 30.0 mass parts per 100 mass parts of the pigment; and a resin B having an acid value of at least 2.0 mg KOH/g and a glass transition temperature TgB of at least 50° C., wherein a hydrophobic parameter HPA of the resin A and a hydrophobic parameter HPB of the resin B satisfy:

HPA≥0.60 where HPA represents a volume fraction of heptane at a point of precipitation by the resin A as measured by the addition of heptane to a solution containing 0.01 mass parts of the resin A and 1.48 mass parts of chloroform, HPB≤0.70 where HPB represents a volume fraction of heptane at a point of precipitation by the resin B as measured by the addition of heptane to a solution containing 0.01 mass parts of the resin B and 1.48 mass parts of chloroform, and $$HPA-HPB>0.$$

2. The toner according to claim 1, wherein the pigment has a pKa of 4.0 to 7.0, where pKa is a base dissociation constant measured by preparing a pigment dispersion in which 10.0 mass parts of the pigment, 140.0 mass parts of toluene and 60.0 mass parts of ethanol are mixed, and then subjecting to neutralization titration with a 0.1 mol/L hydrochloric acid ethanol solution.

3. The toner according to claim 1, wherein the pigment has a base value of 0.9 to 3.0 mg KOH/g.

4. The toner according to claim 1, wherein the pigment having a structure derived from a basic compound is a pigment containing an organic dye having basic segments, the organic dye having a structure represented by Formula (2):

(2)

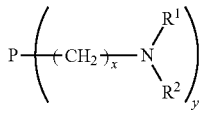

where P is an organic dye, x is 1 or 2, y is a value of 1 to 4, and each of $R^1$ and $R^2$ independently represents a hydrogen atom, or linear or branched alkyl group, or a group needed for forming a heterocycle in which $R^1$ and $R^2$ bind together.

5. The toner according to claim 4, wherein P is an organic dye having a phthalocyanine skeleton or quinacridone skeleton.

6. The toner according to claim 1, wherein the pigment having a structure derived from a basic compound is a pigment having a basic functional group represented by Formula (8):

(8)

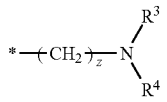

where * represents a segment binding to the pigment, z is 1 or 2, and each of $R^3$ and $R^4$ independently represents a hydrogen atom, or linear or branched alkyl group, or a group needed for forming a heterocycle in which $R^3$ and $R^4$ bind together.

7. The toner according to claim 1, wherein the acidic functional group of the resin A is a carboxyl group or sulfo group.

8. The toner according to claim 1, wherein the resin A has a structure represented by Formula (3):

(3)

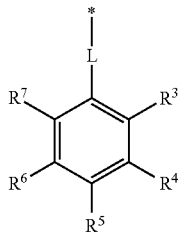

where either $R^4$ or $R^5$ is a carboxyl group, while each of the $R^3$, $R^4$, $R^5$, $R^6$ and $R^7$ other than the carboxyl group independently represents a hydrogen atom, hydroxy group, amino group, $C_{1-8}$ alkoxy group or $C_{1-8}$ alkyl group, L is a linking group represented by Formula (4), and * is a segment binding to a main chain skeleton of the resin A;

(4)

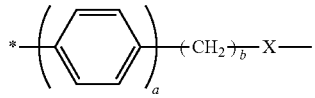

where a is 0 or 1, b is an integer of 0 to 4, X is a single bond or a group represented by —O—, —S— or —$NR^8$—, $R^8$ is a hydrogen atom or $C_{1-4}$ alkyl group, and * is a segment binding to the main chain skeleton of the resin A.

9. The toner according to claim 8, wherein the structure represented by Formula (3) is represented by Formula (5):

(5)

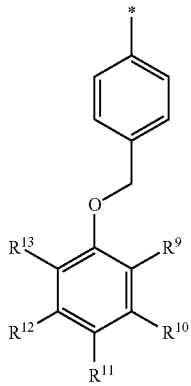

where one of $R^{10}$ and $R^{11}$ is a carboxyl group, while the other is a hydroxy group, each of $R^9$, $R^{12}$ and $R^{13}$ independently represents a hydrogen atom, hydroxy group, amino group, $C_{1-4}$ alkoxy group or $C_{1-4}$ alkyl group, and * is a segment binding to the main chain skeleton of the resin A.

10. The toner according to claim 1, wherein the resin A has a structure represented by Formula (6):

(6)

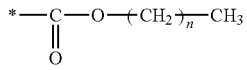

where n is an integer of 3 to 21, and * is a segment binding to a main chain skeleton of the resin A.

11. The toner according to claim 1, wherein the resin A has an acid value of 3.0 to 25.0 mg KOH/g.

12. The toner according to claim 1, wherein the resin A has a weight-average molecular weight (Mw) of 10000 to 75000.

13. The toner according to claim 1, wherein HPA−HPB≥0.05.

14. The toner according to claim 1, wherein the content of the resin A is at least 1.0 mass part per 100 mass parts of the resin B.

15. The toner according to claim 1, wherein the HPB is not more than 0.60.

16. The toner according to claim 1, wherein the content of the resin A is 1.0 to 70.0 mass parts per 100 mass parts of the resin B.

17. A method for producing a toner comprising a toner particle, the toner particle comprising a binder resin, a pigment having a structure derived from a basic compound, a resin A having an acidic functional group, and a resin B, wherein the method comprises step (i) or step (ii) below:

(i) a step of granulating, in an aqueous medium, a polymerizable monomer composition containing the resin A, the resin B, the pigment and a vinyl polymerizable monomer capable of forming a binder resin, and polymerizing the vinyl polymerizable monomer contained in the polymerizable monomer composition to thereby manufacture the toner particle;

(ii) a step of granulating, in an aqueous medium, an organic solvent dispersion containing the binder resin, the resin A, the resin B and the pigment in an organic solvent, to thereby manufacture the toner particle, wherein the content of resin A is 1.0 to 30.0 mass parts per 100 mass parts of the pigment, the resin B has an acid value of at least 2.0 mg KOH/gm and a glass transition temperature TgB of at least 50° C., wherein a hydrophobic parameter HPA of the resin A and a hydrophobic parameter HPB of the resin B satisfy:

HPA≥0.60 where HPA represents a volume fraction of heptane at a point of precipitation by the resin A as measured by the addition of heptane to a solution containing 0.01 mass parts of the resin A and 1.48 mass parts of chloroform, HPB≤0.70 where HPB represents a volume fraction of heptane at a point of precipitation by the resin B as measured by the addition of heptane to a solution containing 0.01 mass parts of the resin B and 1.48 mass parts of chloroform, and $HPA-HPB>0$.

* * * * *